US009488399B2

(12) United States Patent
Kanazawa et al.

(10) Patent No.: US 9,488,399 B2
(45) Date of Patent: Nov. 8, 2016

(54) AIR CONDITIONING APPARATUS

(71) Applicant: DAIKIN INDUSTRIES, LTD., Osaka-shi, Osaka (JP)

(72) Inventors: Yukako Kanazawa, Sakai (JP); Junichi Shimoda, Sakai (JP); Tatsuya Makino, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/390,776

(22) PCT Filed: Apr. 1, 2013

(86) PCT No.: PCT/JP2013/059924
§ 371 (c)(1),
(2) Date: Oct. 4, 2014

(87) PCT Pub. No.: WO2013/153983
PCT Pub. Date: Oct. 17, 2013

(65) Prior Publication Data

US 2015/0059377 A1 Mar. 5, 2015

(30) Foreign Application Priority Data

Apr. 9, 2012 (JP) ..... 2012-088668

(51) Int. Cl.
*F25B 13/00* (2006.01)
*F25B 49/02* (2006.01)
(Continued)

(52) U.S. Cl.
CPC ..... *F25B 49/02* (2013.01); *F24F 1/18* (2013.01); *F25B 13/00* (2013.01); *F25B 41/046* (2013.01);
(Continued)

(58) Field of Classification Search
CPC ..... F25B 13/00; F25B 2313/005; F25B 2313/02741; F25B 2313/0292; F25B 2313/0314; F25B 2313/0315; F25B 2600/0251; F25B 41/046; F25B 49/02; F25B 2500/28
USPC ..... 62/160, 324.1, 324.6
See application file for complete search history.

(56) References Cited

U.S. PATENT DOCUMENTS 4,402,190 A * 9/1983 Reid ..... 62/178
4,638,643 A * 1/1987 Sakazume ..... F25B 49/025 318/436
(Continued)

FOREIGN PATENT DOCUMENTS

CN 1786621 A 6/2006
CN 101086375 A 12/2007
(Continued)

OTHER PUBLICATIONS

International Search Report of corresponding PCT Application No. 2013/059924 dated Jun. 25, 2013.
(Continued)

*Primary Examiner* — M. Alexandra Elve
*Assistant Examiner* — Henry Crenshaw
(74) *Attorney, Agent, or Firm* — Global IP Counselors

(57) ABSTRACT

An air conditioning apparatus has a refrigerant circuit in which a compressor, a four-way switching valve, an outdoor heat exchanger, an expansion valve, and an indoor heat exchanger are interconnected. The outdoor heat exchanger uses multi-hole flat tubes as heat transfer tubes. When stopping a heating operation, the air conditioning apparatus performs pressure equalization control that switches the four-way switching valve from a heating cycle state to a cooling cycle state, thereafter stops the compressor, and equalizes the pressure in the refrigerant circuit.

19 Claims, 8 Drawing Sheets

(51) Int. Cl.
*F24F 1/18* (2011.01)
*F25B 41/04* (2006.01)

(52) U.S. Cl.
CPC .... *F25B 2313/005* (2013.01); *F25B 2313/006* (2013.01); *F25B 2313/0292* (2013.01); *F25B 2313/0293* (2013.01); *F25B 2313/0294* (2013.01); *F25B 2313/02741* (2013.01); *F25B 2313/0314* (2013.01); *F25B 2313/0315* (2013.01); *F25B 2400/19* (2013.01); *F25B 2500/12* (2013.01); *F25B 2600/0251* (2013.01); *F25B 2600/2507* (2013.01); *F25B 2600/2513* (2013.01); *F25B 2700/1931* (2013.01); *F25B 2700/21151* (2013.01); *F25B 2700/21152* (2013.01)

(56) References Cited

U.S. PATENT DOCUMENTS 5,263,333 A * 11/1993 Kubo et al. ..... 62/160
5,623,834 A * 4/1997 Bahel et al. ..... 62/131
5,970,732 A * 10/1999 Menin et al. ..... 62/201
6,125,885 A * 10/2000 Hirata et al. ..... 137/625.43
6,266,968 B1 * 7/2001 Redlich ..... 62/204
6,508,072 B1 * 1/2003 Kanazawa ..... F04B 49/20 236/78 D
2003/0233838 A1 * 12/2003 Lee et al. ..... 62/175
2004/0103676 A1 * 6/2004 Lee et al. ..... 62/160
2004/0107727 A1 * 6/2004 Kim et al. ..... 62/525
2006/0179855 A1 * 8/2006 Lifson et al. ..... 62/160
2006/0218947 A1 10/2006 Lifson et al.
2007/0167127 A1 * 7/2007 Wiley ..... 454/229
2008/0083236 A1 4/2008 Song
2009/0229285 A1 * 9/2009 Sato ..... F25B 41/00 62/149
2009/0320507 A1 * 12/2009 Saruwatari et al. ..... 62/234
2010/0101256 A1 * 4/2010 Kawano et al. ..... 62/324.6
2011/0079032 A1 * 4/2011 Taras et al. ..... 62/113
2011/0192183 A1 * 8/2011 Ha et al. ..... 62/196.1

FOREIGN PATENT DOCUMENTS

JP 2009-210139 A 9/2009
JP 2011-80649 A 4/2011
WO 2012/014769 A1 2/2012

OTHER PUBLICATIONS

International Preliminary Report of corresponding PCT Application No. PCT/JP2013/059924 dated Oct. 23, 2014.
Extended European search report for the corresponding European application No. 13 77 6366, issued on Feb. 1, 2016.

* cited by examiner

AIR CONDITIONING APPARATUS

CROSS-REFERENCE TO RELATED APPLICATIONS

This U.S. National stage application claims priority under 35 U.S.C. §119(a) to Japanese Patent Application No. 2012-088668, filed in Japan on Apr. 9, 2012, the entire contents of which are hereby incorporated herein by reference.

TECHNICAL FIELD

The present invention relates to an air conditioning apparatus and particularly an air conditioning apparatus that uses a four-way switching valve to switch between and perform a cooling operation and a heating operation.

BACKGROUND ART

Conventionally, there have been air conditioning apparatus that use a four-way switching valve to switch between and perform a cooling operation and a heating operation, such as described in Japanese Laid-Open Publication JP-A No. 2011-80649. Specifically, the air conditioning apparatus has a refrigerant circuit configured as a result of a compressor, a four-way switching valve, an outdoor heat exchanger, an expansion valve, and an indoor heat exchanger being interconnected. Additionally, the air conditioning apparatus switches the four-way switching valve to a cooling cycle state to thereby perform a cooling operation that circulates refrigerant in the order of the compressor, the outdoor heat exchanger, the expansion valve, and the indoor heat exchanger. Furthermore, the air conditioning apparatus switches the four-way switching valve to a heating cycle state to thereby perform a heating operation that circulates the refrigerant in the order of the compressor, the indoor heat exchanger, the expansion valve, and the outdoor heat exchanger.

SUMMARY

In the above-described conventional air conditioning apparatus, when stopping the cooling operation as a result of the thermo-off or receiving a command from a remote controller, the air conditioning apparatus maintains the four-way switching valve in the cooling cycle state and stops the compressor, and when stopping the heating operation, the air conditioning apparatus maintains the four-way switching valve in the heating cycle state and stops the compressor. This equalizes the pressure in the refrigerant circuit of the air conditioning apparatus. At this time, the refrigerant in the refrigerant circuit flows from the section that had been at a high pressure in the refrigeration cycle during the heating operation (the section from the discharge side of the compressor to the expansion valve) to the section that had been at a low pressure in the refrigeration cycle during the heating operation (the section from the expansion valve to the suction side of the compressor). That is, during the pressure equalization of the refrigerant circuit when stopping the heating operation, the refrigerant flows from the expansion valve through the outdoor heat exchanger toward the suction side of the compressor.

Here, in the above-described conventional air conditioning apparatus, when a heat exchanger that uses multi-hole flat tubes as heat transfer tubes is employed as the outdoor heat exchanger, liquid refrigerant that has collected in the multi-hole flat tubes of the outdoor heat exchanger is pushed out to the suction side of the compressor by the flow of the refrigerant in the refrigerant circuit during the above-described pressure equalization.

For this reason, during the pressure equalization, a large quantity of liquid refrigerant flows from the outdoor heat exchanger to the suction side of the compressor, and in a case where the air conditioning apparatus has an accumulator that temporarily accumulates the refrigerant sucked into the compressor, there is the concern that a large quantity of liquid refrigerant will accumulate in the accumulator. Additionally, there is the concern that when the heating operation is resumed thereafter, the compressor will suck in the liquid refrigerant, and because of this, there is the concern that the reliability of the compressor will be compromised.

It is a problem of the present invention to make it more difficult, in an air conditioning apparatus that uses a four-way switching valve to switch between and perform a cooling operation and a heating operation, for a compressor to suck in liquid refrigerant when a heating operation is resumed even when a heat exchanger that uses multi-hole flat tubes as heat transfer tubes is employed as an outdoor heat exchanger.

An air conditioning apparatus pertaining to a first aspect has a refrigerant circuit configured as a result of a compressor, a four-way switching valve, an outdoor heat exchanger, an expansion valve, and an indoor heat exchanger being interconnected. The air conditioning apparatus switches the four-way switching valve to a cooling cycle state to thereby perform a cooling operation that circulates refrigerant in the order of the compressor, the outdoor heat exchanger, the expansion valve, and the indoor heat exchanger. The air conditioning apparatus switches the four-way switching valve to a heating cycle state to thereby perform a heating operation that circulates the refrigerant in the order of the compressor, the indoor heat exchanger, the expansion valve, and the outdoor heat exchanger. The outdoor heat exchanger is a heat exchanger that uses multi-hole flat tubes as heat transfer tubes. When stopping the heating operation, the air conditioning apparatus performs pressure equalization control that switches the four-way switching valve from the heating cycle state to the cooling cycle state, stops the compressor, and equalizes the pressure in the refrigerant circuit.

In an air conditioning apparatus that uses a four-way switching valve to switch between and perform a cooling operation and a heating operation, the outdoor heat exchanger functions as an evaporator of the refrigerant during the heating operation. For this reason, when the air conditioning apparatus stops the heating operation, liquid refrigerant collects in the heat transfer tubes of the outdoor heat exchanger regardless of whether round tubes or multi-hole flat tubes are used as the heat transfer tubes of the outdoor heat exchanger.

However, in a case where the air conditioning apparatus employs an outdoor heat exchanger that uses round tubes as the heat transfer tubes, virtually none of the liquid refrigerant that has collected in the round tubes is pushed out to the suction side of the compressor by the flow of the refrigerant in the refrigerant circuit during the pressure equalization, even when the air conditioning apparatus maintains the four-way switching valve in the heating cycle state and stops the compressor. The reason is because in a case where round tubes are used as the heat transfer tubes, liquid refrigerant flows in spaces in the lower portions of the round tubes and gas refrigerant flows in spaces in the upper portions of the round tubes, so even when the refrigerant flows into the outdoor heat exchanger from the expansion valve during the pressure equalization, mainly the gas refrigerant in the spaces in the upper portions of the round tubes is pushed out.

In contrast, in a case where the air conditioning apparatus employs an outdoor heat exchanger that uses multi-hole flat tubes as the heat transfer tubes, the numerous small refrigerant flow paths formed in the multi-hole flat tubes end up being almost completely filled with liquid refrigerant, and almost no spaces through which gas refrigerant flows are formed. For this reason, in a case where the air conditioning apparatus employs an outdoor heat exchanger that uses multi-hole flat tubes as the heat transfer tubes, when the air conditioning apparatus maintains the four-way switching valve in the heating cycle state and stops the compressor, liquid refrigerant that has collected in the multi-hole flat tubes ends up being pushed out to the suction side of the compressor by the flow of the refrigerant in the refrigerant circuit during the pressure equalization.

Therefore, in the air conditioning apparatus pertaining to the first aspect, in consideration of differences in the behavior of the refrigerant during the pressure equalization due to the type of the heat transfer tubes, when stopping the heating operation, a control unit of the air conditioning apparatus is configured to perform the pressure equalization control that switches the four-way switching valve from the heating cycle state to the cooling cycle state and thereafter stops the compressor.

Because of this, in the air conditioning apparatus pertaining to the first aspect, because of the four-way switching valve that has been switched to the cooling cycle state, a flow in which the refrigerant flows into the outdoor heat exchanger from the expansion valve during the pressure equalization is no longer generated in the refrigerant circuit. For this reason, it becomes difficult thr liquid refrigerant that has collected in the heat transfer tubes comprising multi-hole flat tubes of the outdoor heat exchanger during the heating operation to be pushed out to the suction side of the compressor during the pressure equalization. Thus, it becomes difficult for a large quantity of liquid refrigerant to flow into and collect in the suction side of the compressor from the outdoor heat exchanger during the pressure equalization.

In this way, in the air conditioning apparatus pertaining to the first aspect, by performing the above-described pressure equalization control, it can be made difficult for the compressor to suck in liquid refrigerant when the heating operation is resumed, even when the air conditioning apparatus employs as the outdoor heat exchanger a heat exchanger that uses multi-hole flat tubes as the heat transfer tubes.

An air conditioning apparatus pertaining to a second aspect is the air conditioning apparatus pertaining to the first aspect, wherein at the time of the pressure equalization control, the air conditioning apparatus performs outdoor heat exchanger refrigerant discharge control that switches the four-way switching valve to the cooling cycle state and thereafter continues the operation of the compressor.

Because of the above-described pressure equalization control, liquid refrigerant can be kept from being pushed out to the suction side of the compressor from the outdoor heat exchanger when the air conditioning apparatus stops the heating operation. However, it is not the case that, because of this, liquid refrigerant will no longer collect in the outdoor heat exchanger. For this reason, there remains the concern that when the heating operation is resumed, some of the liquid refrigerant that has collected in the outdoor heat exchanger will be pushed out to the suction side of the compressor and that the liquid refrigerant will flow into the suction side of the compressor from the outdoor heat exchanger.

Therefore, in the air conditioning apparatus pertaining to the second aspect, at the time of the pressure equalization control, the control unit is configured to perform the outdoor heat exchanger refrigerant discharge control that switches the four-way switching valve to the cooling cycle state and thereafter continues the operation of the compressor.

Because of this, in the air conditioning apparatus pertaining to the second aspect, the timing when the air conditioning apparatus stops the compressor is delayed compared to the timing when the air conditioning apparatus switches the four-way switching valve to the cooling cycle state, and a flow of refrigerant that circulates in the same way as during the cooling operation can be generated in the refrigerant circuit before the air conditioning apparatus stops the compressor. For this reason, liquid refrigerant that has collected in the heat transfer tribes comprising multi-hole flat tubes of the outdoor heat exchanger during the heating operation can be discharged through the expansion valve to the indoor heat exchanger side before the air conditioning apparatus stops the compressor. Thus, during the pressure equalization, it not only becomes difficult for a large quantity of liquid refrigerant to flow into and collect in the suction side of the compressor from the outdoor heat exchanger, but the quantity of liquid refrigerant that collects in the outdoor heat exchanger after the heating operation is stopped can be reduced.

In this way, in the air conditioning apparatus pertaining to the second aspect, by performing the above-described outdoor heat exchanger refrigerant discharge control, the concern that liquid refrigerant will flow into the suction side of the compressor from the outdoor heat exchanger when the heating operation is resumed can be reduced.

An air conditioning apparatus pertaining to a third aspect is the air conditioning apparatus pertaining to the second aspect, wherein the air conditioning apparatus further has an indoor fan that supplies, to the indoor heat exchanger, room air serving as a heating source or a cooling source of the refrigerant flowing through the indoor heat exchanger. At the time of the outdoor heat exchanger refrigerant discharge control, the air conditioning apparatus switches the four-way switching valve to the cooling cycle state and thereafter stops the indoor fan.

The above-described outdoor heat exchanger refrigerant discharge control generates in the refrigerant circuit a flow of refrigerant that circulates in the same way as during the cooling operation, so the indoor heat exchanger functions as an evaporator of the refrigerant. For this reason, in a configuration having an indoor fan, although it is temporary, cool air ends up being blown into the room and a cool sensation becomes imparted to the people in the room, which is undesirable.

Therefore, the air conditioning apparatus pertaining to the third aspect, the control unit is configured to perform control that stops the indoor fan at the time of the outdoor heat exchanger refrigerant discharge control.

Because of this, in the air conditioning apparatus pertaining to the third aspect, at the time of the outdoor heat exchanger refrigerant discharge control, it can be ensured that cool air is not blown into the room and it can be made difficult for a cool sensation to be imparted to the people in the room.

An air conditioning apparatus pertaining to a fourth aspect is the air conditioning apparatus pertaining to the second or third aspect, wherein the air conditioning apparatus further has an outdoor fan that supplies, to the outdoor heat exchanger, outdoor air serving as a cooling source or a heating source of the refrigerant flowing through the outdoor heat exchanger. At the time of the outdoor heat exchanger refrigerant discharge control, the air conditioning apparatus switches the four-way switching valve to the cooling cycle state and thereafter stops the outdoor fan.

The above-described outdoor heat exchanger refrigerant discharge control generates in the refrigerant circuit a flow of refrigerant that circulates in the same way as during the cooling operation, so the outdoor heat exchanger functions as a condenser of the refrigerant. For this reason, in a configuration having an outdoor fan, the generation of liquid refrigerant in the outdoor heat exchanger is accelerated despite the fact that liquid refrigerant that has collected in the outdoor heat exchanger during the heating operation is discharged to the indoor heat exchanger side by the outdoor heat exchanger refrigerant discharge control, which is undesirable.

Therefore, the air conditioning apparatus pertaining to the fourth aspect, the control unit is configured to perform control that stops the outdoor fan at the time of the outdoor heat exchanger refrigerant discharge control.

Because of this, in the air conditioning apparatus pertaining to the fourth aspect, at the time of the outdoor heat exchanger refrigerant discharge control, liquid refrigerant can be kept from being generated in the outdoor heat exchanger and the discharge of the liquid refrigerant that has accumulated in the outdoor heat exchanger through the expansion valve to the indoor heat exchanger side can be accelerated.

An air conditioning apparatus pertaining to a fifth aspect is the air conditioning apparatus pertaining to any one of the first to fourth aspects, wherein the refrigerant circuit further has an accumulator that temporarily accumulates the refrigerant sucked into the compressor. Before the pressure equalization control, the air conditioning apparatus performs accumulator refrigerant discharge control that reduces the opening degree of the expansion valve.

In a configuration having an accumulator, even if liquid refrigerant were to be pushed out to the suction side of the compressor from the outdoor heat exchanger during the pressure equalization of the refrigerant circuit when stopping the heating operation, this liquid refrigerant can be accumulated in the accumulator. For this reason, in terms of the configuration of the refrigerant circuit, it becomes difficult for the compressor to suck in liquid refrigerant when the heating operation is resumed.

However, even in a configuration having an accumulator, there are cases where liquid refrigerant has already accumulated in the accumulator during the heating operation. In this case, if the above-described pressure equalization control is not performed and liquid refrigerant is allowed to be pushed out to the suction side of the compressor from the outdoor heat exchanger during the pressure equalization of the refrigerant circuit when stopping the heating operation, the quantity of liquid refrigerant accumulating in the accumulator during the pressure equalization ends up becoming extremely large. Thus, there is the concern that when the heating operation is resumed, the liquid refrigerant accumulating in the accumulator will end up overflowing out to the suction side of the compressor and that the compressor will suck in the liquid refrigerant.

Therefore, the air conditioning apparatus pertaining to the fifth aspect is configured to perform the above-described pressure equalization control despite the fact that it has a configuration having an accumulator. Because of this, the liquid refrigerant accumulating in the accumulator can generally be kept from overflowing out to the suction side of the compressor when the heating operation is resumed.

Yet in a case where the quantity of liquid refrigerant accumulating in the accumulator is extremely large, some concern remains that even if the above-described pressure equalization control is performed, the liquid refrigerant accumulating in the accumulator will not be able to be kept from flowing out to the suction side of the compressor when the heating operation is resumed.

Therefore, the air conditioning apparatus pertaining to the fifth aspect, the control unit is configured to not only perform the above-described pressure equalization control in a configuration having an accumulator but also perform the accumulator refrigerant discharge control that reduces the opening degree of the expansion valve before the pressure equalization control. At this time, it is preferred that the opening degree of the expansion valve be set to an opening degree that is smaller than the opening degree before starting the accumulator refrigerant discharge control.

Because of this, in the air conditioning apparatus pertaining to the fifth aspect, by reducing, before the pressure equalization control, the opening degree of the expansion valve while maintaining in the refrigerant circuit a flow of refrigerant that circulates in the same way as during the heating operation, a pump down-like operation that sends the liquid refrigerant to the indoor heat exchanger side of the expansion valve can be performed. For this reason, before the pressure equalization control, refrigerant that has accumulated in the accumulator can be discharged and sent through the compressor to the indoor heat exchanger side, and the flow rate of the refrigerant returning to the outdoor heat exchanger and the accumulator can be reduced. Thus, before the pressure equalization control, a state in which the quantity of liquid refrigerant accumulating in the accumulator is extremely large can be eliminated, and the quantity of liquid refrigerant that accumulates in the outdoor heat exchanger during the pressure equalization and after the heating operation can be reduced.

In this way, in the air conditioning apparatus pertaining to the fifth aspect, by performing the above-described accumulator refrigerant discharge control in a configuration having an accumulator, liquid refrigerant accumulating in the accumulator can be kept from overflowing out to the suction side of the compressor.

An air conditioning apparatus pertaining to a sixth aspect is the air conditioning apparatus pertaining to any one of the first to fifth aspects, wherein before the pressure equalization control, the air conditioning apparatus performs four-way switching noise reduction control that reduces the operating frequency of the compressor.

In the above-described pressure equalization control, the four-way switching valve is switched from the heating cycle state to the cooling cycle state in a state in which the pressure in the refrigerant circuit is not equalized. For this reason, the switching becomes performed in a state in which the high-low pressure difference between the four ports of the four-way switching valve is large, and the switching noise made during the switching operation of the four-way switching valve tends to become louder.

Therefore, the air conditioning apparatus pertaining to the sixth aspect, the control unit is configured to perform, before the pressure equalization control, the four-way switching noise reduction control that reduces the operating frequency of the compressor. At this time, it is preferred that the operating frequency of the compressor be set to an operating frequency that is smaller than the operating frequency before starting the four-way switching noise reduction control.

Because of this, in the air conditioning apparatus pertaining to the sixth aspect, when the air conditioning apparatus switches the four-way switching valve from the heating cycle state to the cooling cycle state, the high-low pressure difference between the four ports of the four-way switching valve can be reduced and the switching noise made by the four-way switching valve can be reduced.

An air conditioning apparatus pertaining to a seventh aspect is the air conditioning apparatus pertaining to the sixth aspect, wherein in a case where the stopping of the heating operation is an abnormal stop, the air conditioning apparatus does not perform the four-way switching noise reduction control.

The object of the above-described four-way switching noise reduction control is to reduce the switching noise made during the switching operation of the four-way switching valve. For this reason, when the air conditioning apparatus stops the heating operation as a result of the thermo-off or receiving a command from a remote controller, it is preferred that the air conditioning apparatus perform the four-way switching noise reduction control, but in the case of an abnormal stop caused by a device abnormality, for example, it is preferred that device protection be given priority over reducing the switching noise made by the four-way switching valve and that the air conditioning apparatus be stopped quickly.

Therefore, the air conditioning apparatus pertaining to the seventh aspect, the control unit is configured to not perform the four-way switching noise reduction control in a case where the stopping of the heating operation is an abnormal stop. That is, when stopping the heating operation as a result of the thermo-off or receiving a command from a remote controller, the air conditioning apparatus is configured to perform the pressure equalization control after performing the four-way switching noise reduction control, and in the case of an abnormal stop, the air conditioning apparatus is configured to perform the pressure equalization control without performing the four-way switching noise reduction control.

Because of this, in the air conditioning apparatus pertaining to the seventh aspect, the pressure equalization control can be performed while giving appropriate consideration to both the switching noise made during the switching operation of the four-way switching valve and device protection.

DESCRIPTION OF EMBODIMENT

An embodiment of an air conditioning apparatus pertaining to the present invention and example modifications thereof will be described below on the basis of the drawings. The specific configurations of the air conditioning apparatus pertaining to the present invention are not limited to the following embodiment and the example modifications thereof and can be changed without departing from the spirit of the invention.

(1) Configuration of Air Conditioning Apparatus

Figure 1:
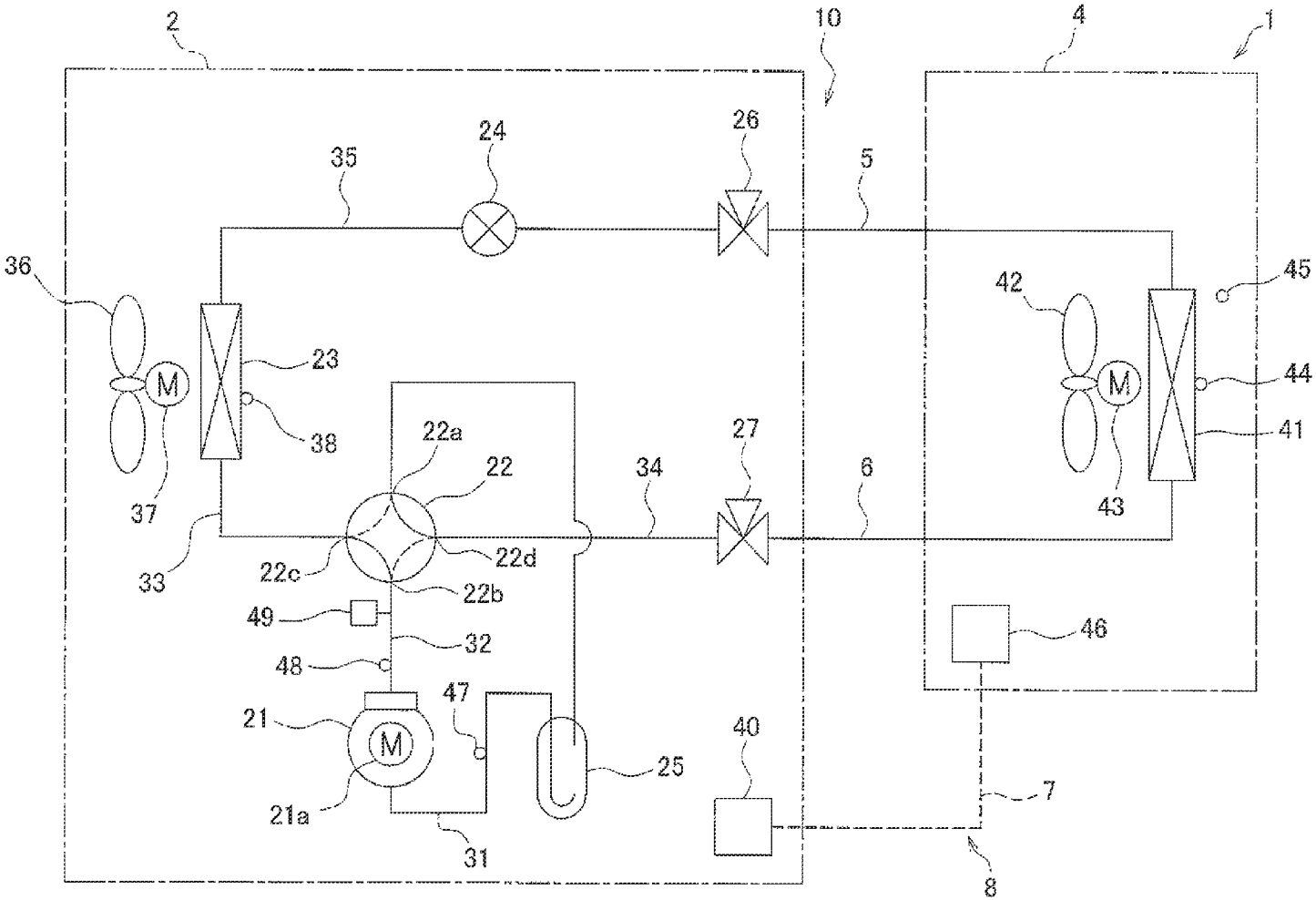
FIG. 1 is a schematic refrigerant circuit diagram of an air conditioning apparatus pertaining to an embodiment of the present invention.

FIG. 1 is a schematic configuration diagram of an air conditioning apparatus 1 pertaining to the embodiment of the present invention.

The air conditioning apparatus 1 is an apparatus that can cool and heat a room in a building, for example, by performing a vapor compression refrigeration cycle. The air conditioning apparatus 1 is mainly configured as a result of an outdoor unit 2 and an indoor unit 4 being interconnected. Here, the outdoor unit 2 and the indoor unit 4 are interconnected by a liquid refrigerant connection pipe 5 and a gas refrigerant connection pipe 6. That is, a vapor compression refrigerant circuit 10 of the air conditioning apparatus 1 is configured as a result of the outdoor unit 2 and the indoor unit 4 being interconnected by the refrigerant connection pipes 5 and 6.

<Indoor Unit>

The indoor unit 4 is installed in a room and configures part of the refrigerant circuit 10. The indoor unit 4 mainly has an indoor heat exchanger 41.

The indoor heat exchanger 41 is a heat exchanger which, during a cooling operation, functions as an evaporator of refrigerant to cool the room air and, during a heating operation, functions as a radiator of the refrigerant to heat the room air. The liquid side of the indoor heat exchanger 41 is connected to the liquid refrigerant connection pipe 5, and the gas side of the indoor heat exchanger 41 is connected to the gas refrigerant connection pipe 6. The indoor heat exchanger 41 here is a heat exchanger that uses round tubes as heat transfer tubes. More specifically, the indoor heat exchanger 41 is a cross fin type fin-and-tube heat exchanger configured by heat transfer tubes comprising round tubes and numerous fins. For the round tubes serving as the heat transfer tubes, tubes having flow path holes with an inner diameter of about 3 to 20 mm are used.

The indoor unit 4 has an indoor fan 42 for sucking room air into the indoor unit 4, causing the room air to exchange heat with the refrigerant in the indoor heat exchanger 41, and supplying the air to the room as supply air. That is, the indoor unit 4 has the indoor fan 42 as a fan that supplies, to the indoor heat exchanger 41, room air serving as a heating source or a cooling source of the refrigerant flowing through the indoor heat exchanger 41. Here, a centrifugal fan or a multi-blade fan driven by an indoor fan motor 43 is used as the indoor fan 42.

Various sensors are disposed in the indoor unit 4. Specifically, an indoor heat exchange temperature sensor 44 that detects a temperature Trr of the refrigerant in the indoor heat exchanger 41 is disposed in the indoor heat exchanger 41. A room air temperature sensor 45 that detects a temperature Tra of the room air sucked into the indoor unit 4 is disposed in the indoor unit 4.

The indoor unit 4 has an indoor-side control unit 46 that controls the actions of each part configuring the indoor unit 4. Additionally, the indoor-side control unit 46 has a microcomputer and a memory disposed in order to control the indoor unit 4, and the indoor-side control unit 46 can exchange control signals and so forth with a remote controller (not shown in the drawings) for individually operating the indoor unit 4 and can exchange control signals and so forth with the outdoor unit 2 via a transmission line 7.

<Outdoor Unit>

The outdoor unit 2 is installed outdoors and configures part of the refrigerant circuit 10. The outdoor unit 2 mainly has a compressor 21, a four-way switching valve 22, an outdoor heat exchanger 23, an expansion valve 24, an accumulator 25, a liquid-side stop valve 26, and a gas-side stop valve 27.

The compressor 21 is a device that compresses low-pressure refrigerant in the refrigeration cycle to a high pressure. The compressor 21 has a closed structure in which a positive-displacement compression element such as rotary or scroll type (not shown in the drawings) is driven to rotate by a compressor motor 21*a* controlled by an inverter. A suction pipe 31 is connected to the suction side of the compressor 21, and a discharge pipe 32 is connected to the discharge side of the compressor 21. The suction pipe 31 is a refrigerant pipe that interconnects the suction side of the compressor 21 and a first port 22*a* of the four-way switching valve 22. The discharge pipe 32 is a refrigerant pipe that interconnects the discharge side of the compressor 21 and a second port 22*b* of the four-way switching valve 22.

The four-way switching valve 22 is a switching valve for switching the direction of the flow of the refrigerant in the refrigerant circuit 10. During the cooling operation, the four-way switching valve 22 performs switching to a cooling cycle state that causes the outdoor heat exchanger 23 to function as a radiator of the refrigerant that has been compressed in the compressor 21 and causes the indoor heat exchanger 41 to function as an evaporator of the refrigerant that has given off heat in the outdoor heat exchanger 23. That is, during the cooling operation, the four-way switching valve 22 performs switching that places the second port 22*b* and a third port 22*c* in communication with one another and places the first port 22*a* and a fourth port 22*d* in communication with one another. Because of this, the discharge side of the compressor 21 (here, the discharge pipe 32) and the gas side of the outdoor heat exchanger 23 (here, a first gas refrigerant pipe 33) become interconnected (see the solid lines of the four-way switching valve 22 in FIG. 1). Moreover, the suction side of the compressor 21 (here, the suction pipe 31) and the gas refrigerant connection pipe 6 side (here, a second gas refrigerant pipe 34) become interconnected (see the solid lines of the four-way switching valve 22 in FIG. 1). Furthermore, the four-way switching valve 22 performs switching to a heating cycle state that causes the outdoor heat exchanger 23 to function as an evaporator of the refrigerant that has given off heat in the indoor heat exchanger 41 and causes the indoor heat exchanger 41 to function as a radiator of the refrigerant that has been compressed in the compressor 21. That is, during the heating operation, the four-way switching valve 22 performs switching that places the second port 22*b* and the fourth port 22*d* in communication with one another and places the first port 22*a* and the third port 22*c* in communication with one another. Because of this, the discharge side of the compressor 21 (here, the discharge pipe 32) and the gas refrigerant connection pipe 6 side (here, the second gas refrigerant pipe 34) become interconnected (see the dashed lines of the four-way switching valve 22 in FIG. 1). Moreover, the suction side of the compressor 21 (here, the suction pipe 31) and the gas side of the outdoor heat exchanger 23 (here, the first gas refrigerant pipe 33) become interconnected (see the dashed lines of the four-way switching valve 22 in FIG. 1). The first gas refrigerant pipe 33 is a refrigerant pipe that interconnects the third port 22*c* of the four-way switching valve 22 and the gas side of the outdoor heat exchanger 23. The second gas refrigerant pipe 34 is a refrigerant pipe that interconnects the fourth port 22*d* of the four-way switching valve 22 and the gas refrigerant connection pipe 6 side.

Figure 2:
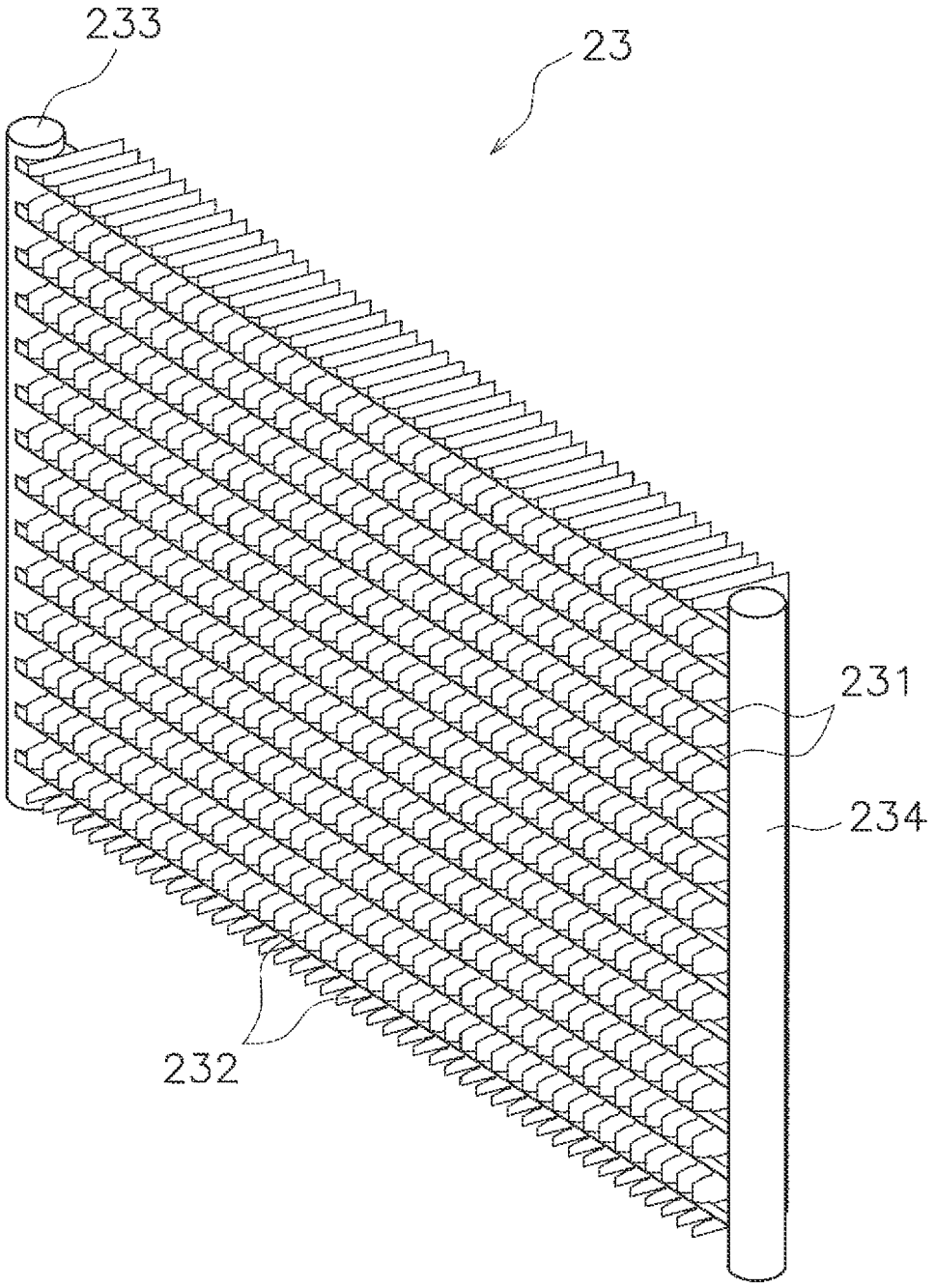
FIG. 2 is a schematic perspective view of an outdoor heat exchanger.
Figure 3:
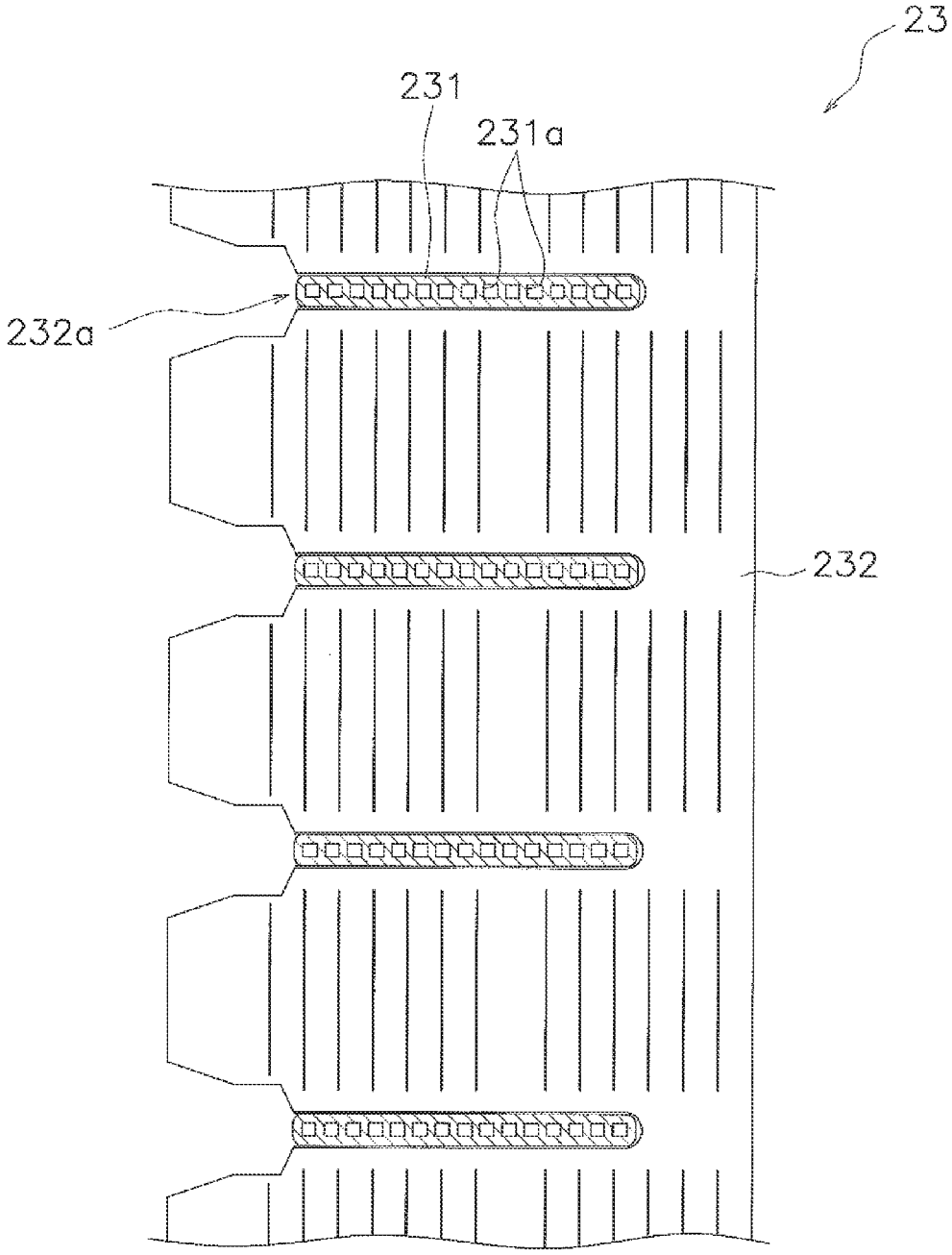
FIG. 3 is a schematic longitudinal sectional view of the outdoor heat exchanger.
Figure 4:
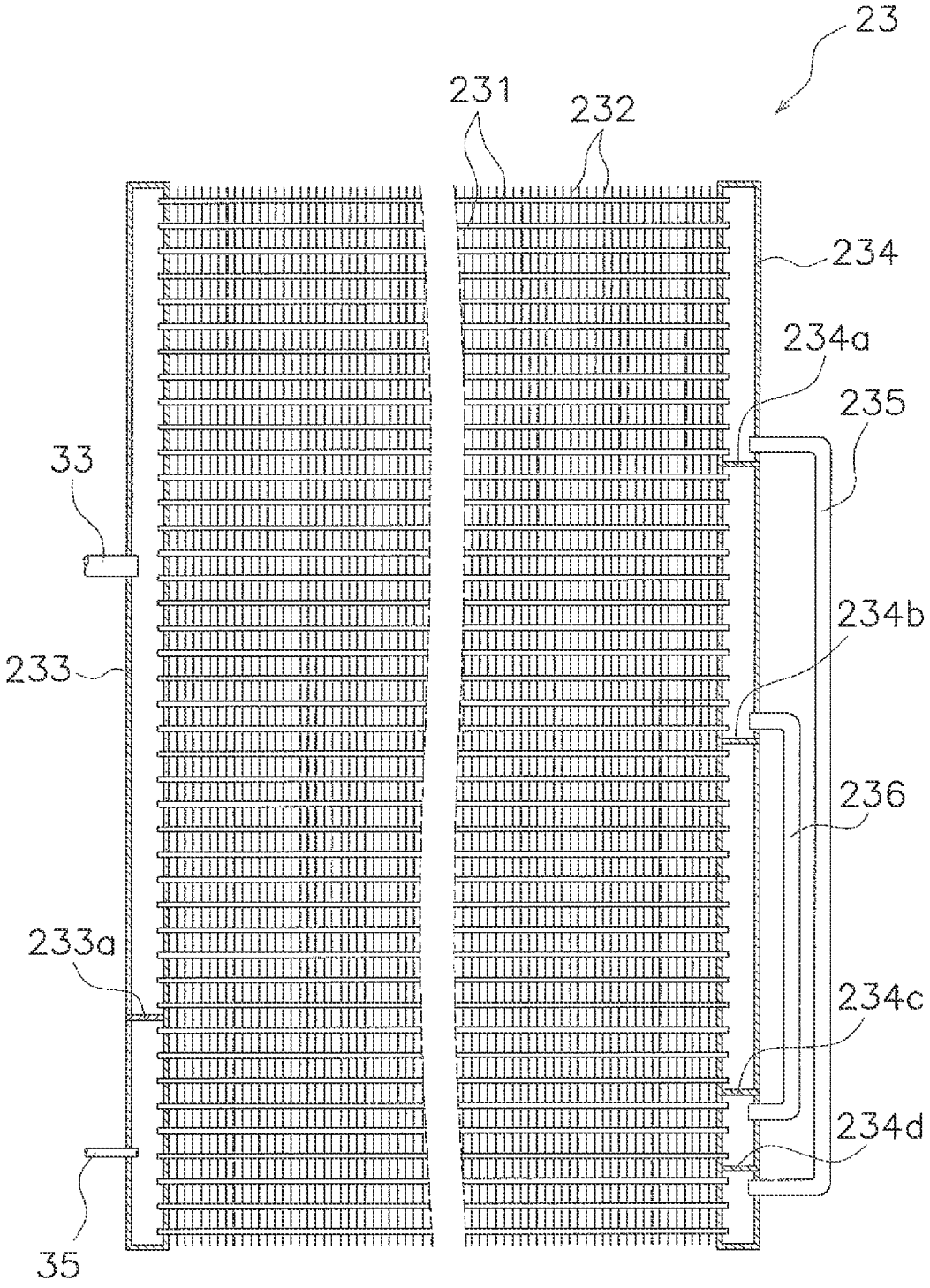
FIG. 4 is a drawing showing refrigerant paths in the outdoor heat exchanger.

The outdoor heat exchanger 23 is a heat exchanger which, during the cooling operation, functions as a radiator of the refrigerant using outdoor air as a cooling source and which, during the heating operation, functions as an evaporator of the refrigerant using outdoor air as a heating source. The liquid side of the outdoor heat exchanger 23 is connected to a liquid refrigerant pipe 35, and the gas side of the outdoor heat exchanger 23 is connected to the first gas refrigerant pipe 33. The liquid refrigerant pipe 35 is a refrigerant pipe that interconnects the liquid side of the outdoor heat exchanger 23 and the liquid refrigerant connection pipe 5 side. That outdoor heat exchanger 23 is a heat exchanger that uses multi-hole flat tubes as heat transfer tubes. More specifically, as shown in FIG. 2 to FIG. 4, the outdoor heat exchanger 23 is an insertion fin stacked heat exchanger mainly configured by heat transfer tubes 231 comprising multi-hole flat tubes and numerous insertion fins 232. The heat transfer tubes 231 comprising multi-hole flat tubes are formed of aluminum or aluminum alloy and have upper and lower planar portions serving as heat transfer surfaces and numerous small refrigerant flow paths 231*a* through which the refrigerant flows. For the refrigerant flow paths 231*a*, refrigerant flow paths having circular flow path holes with an inner diameter equal to or less than 1 mm or polygonal flow path holes having the same sectional area as this are used. The heat transfer tubes 231 are arranged in plural tiers spaced apart from one another in a state in which the planar portions face up and down, and both ends of each of the heat transfer tubes 231 are connected to headers 233 and 234. The insertion fins 232 are fins made of aluminum or aluminum alloy and are in contact with the heat transfer tubes 231. Plural cutouts 232*a* that are long and narrow and extend in the horizontal direction are firmed in the insertion fins 232 so that the insertion fins 232 can be inserted into the plural tiers of heat transfer tubes 231 arranged between both of the headers 233 and 234. The shape of the cutouts 232*a* in these insertion fins 232 substantially matches the outer shape of the cross section of the heat transfer tubes 231. The headers 233 and 234 have the function of the supporting the heat transfer tubes 231, the function of guiding the refrigerant to the refrigerant flow paths 231*a* in the heat transfer tubes 231, and the function of collecting the refrigerant emerging from the refrigerant flow paths 231*a*. The inside space of the header 233 is partitioned into two spaces by a partition plate 233*a*. The inside space of the header 234 is partitioned into five spaces by partition plates 234*a*, 234*b*, 234*c*, and 234*d*. Refrigerant path connection pipes 235 and 236, the first gas refrigerant pipe 33, and the liquid refrigerant pipe 35 (not shown in FIG. 2) are, in addition to the heat transfer tubes 231, connected to the inside spaces in these headers 233 and 234. Additionally, in the cooling operation, high-pressure gas refrigerant in the refrigeration cycle that has been discharged from the compressor 21 flows into the space in the upper portion of the header 233 via the first gas refrigerant pipe 33. Additionally, the gas refrigerant that has flowed into the space in the upper portion of the header 233 is sent through the heat transfer tubes 231 to the upper three inside spaces of the five inside spaces of the header 234, thereafter doubles back, and is sent to the space in the lower portion of the header 233 through the heat transfer tubes 231 disposed below. The refrigerant that was condensed when it passed through the heat transfer tubes 231 flows out to the liquid refrigerant pipe 35 from the space in the lower portion of the header 233 and is sent to the expansion valve 24. During the heating operation, the direction in which the refrigerant flows is the opposite of what it is during the cooling operation.

The expansion valve 24 is a valve which, during the cooling operation, reduces the pressure of the high-pressure refrigerant in the refrigeration cycle that has given off heat in the outdoor heat exchanger 23 to a low pressure in the refrigeration cycle. Furthermore, the expansion valve 24 is a valve which, during the heating operation, reduces the pressure of the high-pressure refrigerant in the refrigeration cycle that has given off heat in the indoor heat exchanger 41 to a low pressure in the refrigeration cycle. The expansion valve 24 is disposed in the section of the liquid refrigerant pipe 35 near the liquid-side stop valve 26. Here, an electrically powered expansion valve is used as the expansion valve 24.

The accumulator 25 is a container that temporarily accumulates the low-pressure refrigerant sucked into the compressor 21. The accumulator 25 is disposed in the suction pipe 31.

The liquid-side stop valve 26 and the gas-side stop valve 27 are valves disposed in openings connecting to outside devices and pipes (specifically, the liquid refrigerant connection pipe 5 and the gas refrigerant connection pipe 6). The liquid-side stop valve 26 is disposed on the end portion of the liquid refrigerant pipe 35. The gas-side stop valve 27 is disposed on the end portion of the second gas refrigerant pipe 34.

The outdoor unit 2 has an outdoor fan 36 for sucking outdoor air into the outdoor unit causing the outdoor air to exchange heat with the refrigerant in the outdoor heat exchanger 23, and expelling the air to the outside. That is, the outdoor unit 2 has an outdoor fan 36 as a fan that supplies, to the outdoor heat exchanger 23, outdoor air serving as a cooling source or a heating source of the refrigerant flowing through the outdoor heat exchanger 23. Here, a propeller fan, for example, driven by an outdoor fan motor 37 is used as the outdoor fan 36.

Various sensors are disposed in the outdoor unit 2. Specifically, an outdoor heat exchange temperature sensor 38 that detects a temperature Tor of the refrigerant in the outdoor heat exchanger 23 is disposed in the outdoor heat exchanger 23. An outdoor air temperature sensor 39 that detects a temperature Toa of the outdoor air sucked into the outdoor unit 2 is disposed in the outdoor unit 2. A suction temperature sensor 47 that detects a temperature Ts of the low-pressure refrigerant in the refrigeration cycle that is sucked into the compressor 21 is disposed in the suction pipe 31 or the compressor 21. A discharge temperature sensor 48 that detects a temperature Td of the high-pressure refrigerant in the refrigeration cycle that is discharged from the compressor 21 is disposed in the discharge pipe 32 or the compressor 21. A discharge pressure sensor 49 that detects a pressure Pd of the high-pressure refrigerant in the refrigeration cycle that is discharged from the compressor 21 is disposed in the discharge pipe 32 or the compressor 21.

The outdoor unit 2 has an outdoor-side control unit 40 that controls the actions of each part configuring the outdoor unit 2. Additionally, the outdoor-side control unit 40 has a microcomputer and a memory disposed in order to control the outdoor unit 2, and the outdoor-side control unit 40 can exchange control signals and so forth with the indoor unit 4 via the transmission line 7.

<Refrigerant Connection Pipes>

The refrigerant connection pipes 5 and 6 are refrigerant pipes installed on site when installing the air conditioning apparatus 1 in an installation location such as a building, and pipes having various lengths and pipe diameters are used depending on installation conditions such as the installation location and the combination of the outdoor unit and the indoor unit.

As described above, the refrigerant circuit 10 of the air conditioning apparatus 1 is configured as a result of the outdoor unit 2, the indoor unit 4, and the refrigerant connection pipes 5 and 6 being connected. The air conditioning apparatus 1 switches the four-way switching valve 22 to the cooling cycle state to thereby circulate the refrigerant in the order of the compressor 21, the outdoor heat exchanger 23, the expansion valve 24, and the indoor heat exchanger 41, drives the outdoor fan 36, and performs the cooling operation. Furthermore, the air conditioning apparatus 1 switches the four-way switching valve 22 to the heating cycle state to thereby circulate the refrigerant in the order of the compressor 21, the indoor heat exchanger 41, the expansion valve 24, and the outdoor heat exchanger 23, drives the outdoor fan 36, and performs the heating operation. Here, the air conditioning apparatus 1 is given a configuration that uses the outdoor air or the room air as a heating source and a cooling source for the outdoor heat exchanger 23 and the indoor heat exchanger 41, but the air conditioning apparatus 1 is not limited to this and may also have a configuration that uses water as a heating source and a cooling source.

<Control Unit>

The air conditioning apparatus 1 can control the various devices in the outdoor unit 2 and the indoor unit 4 using a control unit 8 configured from the indoor-side control unit 46 and the outdoor-side control unit 40. That is, a control unit 8 that controls the operations of the entire air conditioning apparatus 1 including the cooling operation and the heating operation is configured by the indoor-side control unit 46, the outdoor-side control unit 40, and the transmission line 7 that interconnects the indoor-side control unit 46 and the outdoor-side control unit 40.

Figure 5:
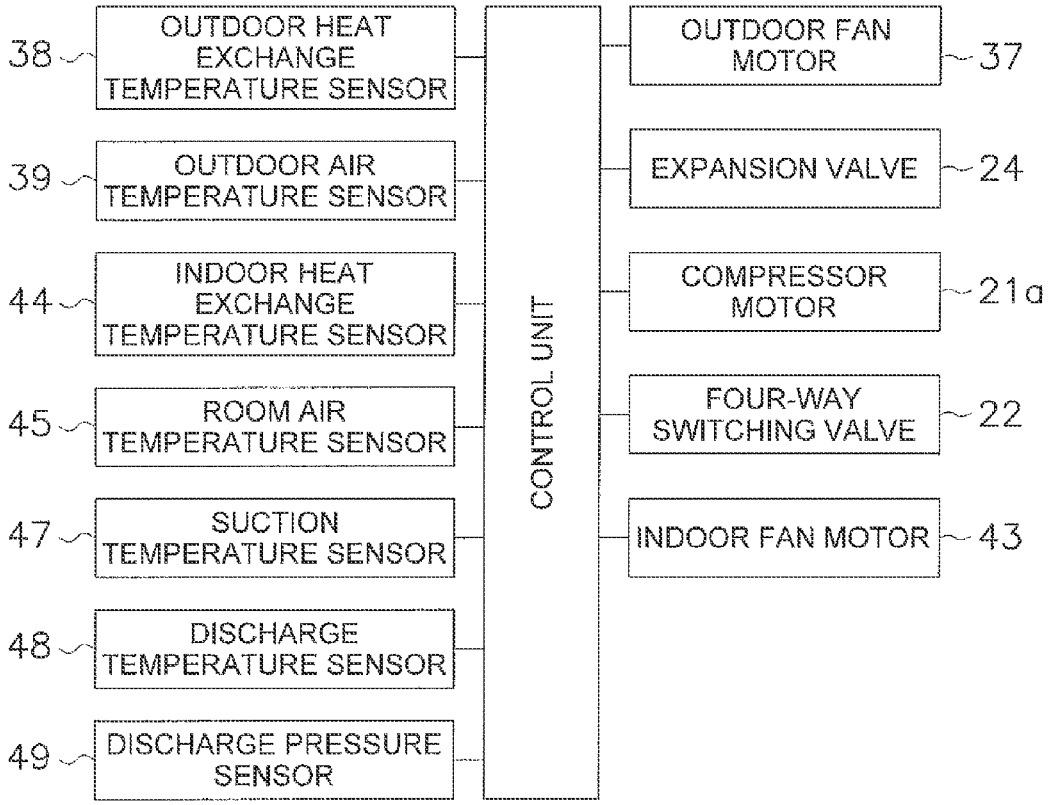
FIG. 5 is a control block diagram of the air conditioning apparatus.

As shown in FIG. 5, the control unit 8 is connected in such a way that it can receive detection signals of the various sensors 38, 39, 44, 45, and 47 to 49 and is connected in such a way that it can control the various devices and valves 21, 22, 24, 37, and 43 on the basis of these detection signals.

(2) Basic Actions of Air Conditioning Apparatus

Next, basic actions (actions excluding heating stop control described later) of the air conditioning apparatus 1 will be described using FIG. 1. The air conditioning apparatus 1 can perform the cooling operation and the heating operation as basic actions. Furthermore, during the heating operation, the air conditioning apparatus 1 can also perform a defrost operation for melting frost sticking to the outdoor heat exchanger 23.

<Heating Operation>

During the heating operation, the four-way switching valve 22 is switched to the heating cycle state (the state indicated by the dashed lines in FIG. 1).

In the refrigerant circuit 10, the low-pressure gas refrigerant in the refrigeration cycle is sucked into the compressor 21, is compressed to a high pressure in the refrigeration cycle, and is thereafter discharged.

The high-pressure gas refrigerant that has been discharged from the compressor 21 is sent through the four-way switching valve 22, the gas-side stop valve 27, and the gas refrigerant connection pipe 6 to the indoor heat exchanger 41.

The high-pressure gas refrigerant that has been sent to the indoor heat exchanger 41 exchanges heat with the room air supplied as a cooling source by the indoor fan 42, gives off heat, and becomes high-pressure liquid refrigerant in the indoor heat exchanger 41. Because of this, the room air is heated and is thereafter supplied to the room, whereby heating of the room is performed.

The high-pressure liquid refrigerant that has given off heat in the indoor heat exchanger 41 is sent through the liquid refrigerant connection pipe 5 and the liquid-side stop valve 26 to the expansion valve 24.

The high-pressure liquid refrigerant that has been sent to the expansion valve 24 has its pressure reduced by the expansion valve 24 to a low pressure in the refrigeration cycle and becomes low-pressure refrigerant in a gas-liquid two-phase state. The low-pressure refrigerant in the gas-liquid two-phase state whose pressure has been reduced by the expansion valve 24 is sent to the outdoor heat exchanger 23.

The low-pressure refrigerant in the gas-liquid two-phase state that has been sent to the outdoor heat exchanger 23 exchanges heat with the room air supplied as a heating source by the outdoor fan 36, evaporates, and becomes low-pressure gas refrigerant in the outdoor heat exchanger 23.

The low-pressure gas refrigerant that has evaporated in the outdoor heat exchanger 23 travels through the four-way switching valve 22 and is sucked back into the compressor 21.

<Cooling Operation>

During the cooling operation, the four-way switching valve 22 is switched to the cooling cycle state (the state indicated by the solid lines in FIG. 1).

In the refrigerant circuit 10, the low-pressure gas refrigerant in the refrigeration cycle is sucked into the compressor 21, is compressed to a high pressure in the refrigeration cycle, and is thereafter discharged.

The high-pressure gas refrigerant that has been discharged from the compressor 21 is sent through the four-way switching valve 22 to the outdoor heat exchanger 23.

The high-pressure gas refrigerant that has been sent to the outdoor heat exchanger 23 exchanges heat with the outdoor air supplied as a cooling source by the outdoor fan 36, gives off heat, and becomes high-pressure liquid refrigerant in the outdoor heat exchanger 23.

The high-pressure liquid refrigerant that has given off heat in the outdoor heat exchanger 23 is sent to the expansion valve 24.

The high-pressure liquid refrigerant that has been sent to the expansion valve 24 has its pressure reduced by the expansion valve 24 to a low pressure in the refrigeration cycle and becomes low-pressure refrigerant in a gas-liquid two-phase state. The low-pressure refrigerant in the gas-liquid two-phase state whose pressure has been reduced by the expansion valve 24 is sent through the liquid-side stop valve 26 and the liquid refrigerant connection pipe 5 to the indoor heat exchanger 41.

The low-pressure refrigerant in the gas-liquid two-phase state that has been sent to the indoor heat exchanger 41 exchanges heat with the room air supplied as a heating source by the indoor fan 42, evaporates, and becomes low-pressure gas refrigerant in the indoor heat exchanger 41. Because of this, the room air is cooled and is thereafter supplied to the room, whereby cooling of the room is performed.

The low-pressure gas refrigerant that has evaporated in the indoor heat exchanger 41 travels through the gas refrigerant connection pipe 6, the gas-side stop valve 27, and the four-way switching valve 22 and is sucked back into the compressor 21.

<Defrost Operation>

During the heating operation, in a case where frost sticking to the outdoor heat exchanger 23 has been detected as a result of the temperature Tor of the refrigerant in the outdoor heat exchanger 23 becoming lower than a predetermined temperature, the air conditioning apparatus 1 performs a defrost operation that melts the frost sticking to the outdoor heat exchanger 23.

Specifically, during the defrost operation, like during the cooling operation, the four-way switching valve 22 is switched to the cooling cycle state (the state indicated by the solid lines in FIG. 1) to thereby cause the outdoor heat exchanger 23 to function as a radiator of the refrigerant. Because of this, the frost sticking to the outdoor heat exchanger 23 can be melted. The flow of the refrigerant in the refrigerant circuit 10 during the defrost operation is the same as what it is during the cooling operation, an description thereof will be omitted here.

(3) Heating Stop Control

When the air conditioning apparatus 1 stops the above-described heating operation as a result of the thermo-off or receiving a command from the remote controller (not shown in the drawings), the air conditioning apparatus 1 maintains the four-way switching valve 22 in the heating cycle state, stops the compressor 21, and equalizes the pressure in the refrigerant circuit 10. Thus, liquid refrigerant that has collected in the multi-hole flat tubes serving as the heat transfer tubes 231 of the outdoor heat exchanger 23 ends up being pushed out to the suction side of the compressor 21 by the flow of the refrigerant in the refrigerant circuit 10 during the pressure equalization. Because of this, there is the concern that when the heating operation is resumed, the compressor 21 will suck in the liquid refrigerant.

Here, in an air conditioning apparatus that uses a four-way switching valve to switch between and perform a cooling operation and a heating operation, the outdoor heat exchanger functions as an evaporator of the refrigerant during the heating operation. For this reason, when the air conditioning apparatus stops the heating operation, liquid refrigerant collects in the heat transfer tubes of the outdoor heat exchanger regardless of whether round tubes or multi-hole flat tubes are used as the heat transfer tubes of the outdoor heat exchanger.

However, in a case where the air conditioning apparatus employs an outdoor heat exchanger that uses round tubes as the heat transfer tubes, virtually none of the liquid refrigerant that has collected in the round tubes is pushed out to the suction side of the compressor by the flow of the refrigerant in the refrigerant circuit during the pressure equalization, even when the air conditioning apparatus maintains the four-way switching valve in the heating cycle state and stops the compressor. The reason is because in a case where round tubes are used as the heat transfer tubes, liquid refrigerant flows in spaces in the lower portions of the round tubes and gas refrigerant flows in spaces in the upper portions of the round tubes, so even when the refrigerant flows into the outdoor heat exchanger from the expansion valve during the pressure equalization, mainly the gas refrigerant in the spaces in the upper portions of the round tubes is pushed out.

In contrast, in a case where the air conditioning apparatus employs the outdoor heat exchanger 23 that uses multi-hole flat tubes as the heat transfer tubes 231 like in the present embodiment, the numerous small refrigerant flow paths 231*a* formed in the multi-hole flat tubes end up being almost completely filled with liquid refrigerant, and almost no spaces through which gas refrigerant flows are formed. For this reason, in a case where the air conditioning apparatus employs the outdoor heat exchanger 23 that uses multi-hole flat tubes as the heat transfer tubes 231, when the air conditioning apparatus 1 maintains the four-way switching valve 22 in the heating cycle state and stops the compressor 21, liquid refrigerant that has collected in the multi-hole flat tubes ends up being pushed out to the suction side of the compressor 21 by the flow of the refrigerant in the refrigerant circuit 10 during the pressure equalization.

Therefore, in the air conditioning apparatus 1 of the present embodiment, as described below, in heating stop control performed when the heating operation is stopped, in consideration of differences in the behavior of the refrigerant during the pressure equalization due to the type of the heat transfer tubes 231, when stopping the heating operation, the air conditioning apparatus 1 is configured to perform pressure equalization control that switches the four-way switching valve 22 from the heating cycle state to the cooling cycle state and thereafter stops the compressor 21.

Figure 6:
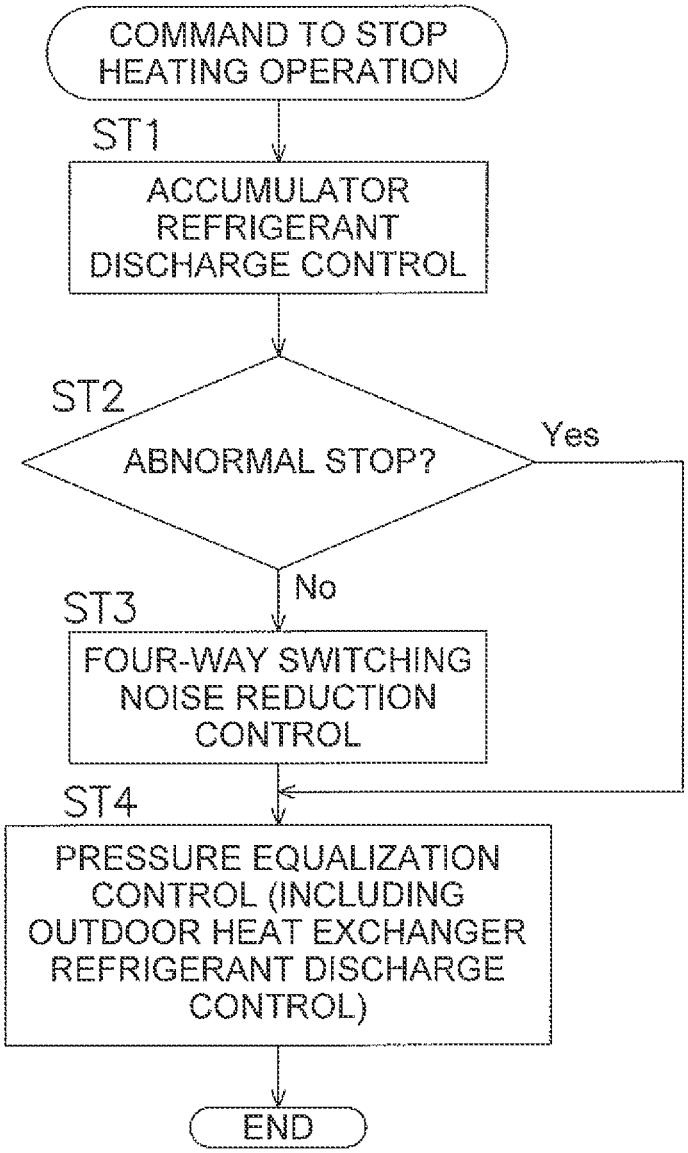
FIG. 6 is a flowchart of heating stop control.
Figure 7:
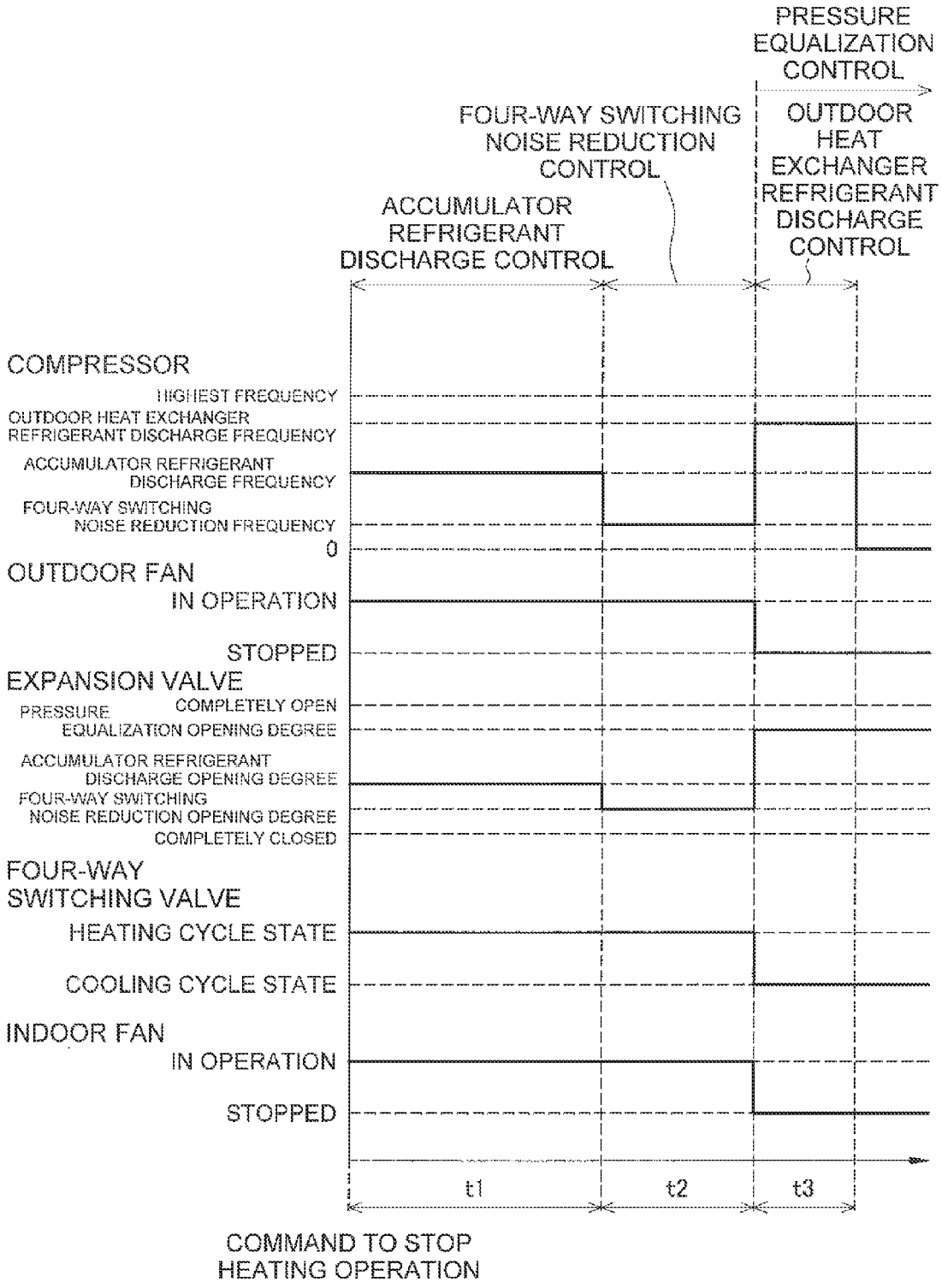
FIG. 7 is a time chart of a compressor, an outdoor fan, an expansion valve, an indoor fan, and a four-way switching valve during the heating stop control (in a case where it is not an abnormal stop)

Next, the heating stop control in the present embodiment will be described using FIG. 1 to FIG. 7. Here, FIG. 6 is a flowchart of the heating stop control. FIG. 7 is a time chart of the compressor 21, the outdoor fan 36, the expansion valve 24, the indoor fan 42, and the four-way switching valve 22 during the heating stop control (in a case where it is not an abnormal stop). The heating stop control described below is, like the above-described basic actions, performed by the control unit 8.

<Step ST4>

When a command to stop the heating operation is given as a result of the thermo-off or by the remote controller (not shown in the drawings), the control unit 8 performs the processing of steps ST1 to ST3 described later and thereafter performs the pressure equalization control of step ST4. In step ST4, when stopping the heating operation, the air conditioning apparatus 1 switches the four-way switching valve 22 from the heating cycle state to the cooling cycle state, stops the compressor 21, and equalizes the pressure in the refrigerant circuit 10. Because of this, because of the four-way switching valve 22 that has been switched to the cooling cycle state, a flow in which the refrigerant flows into the outdoor heat exchanger 23 from the expansion valve 24 during the pressure equalization is no longer generated in the refrigerant circuit 10. For this reason, it becomes difficult for liquid refrigerant that has collected in the heat transfer tubes 231 comprising multi-hole flat tubes of the outdoor heat exchanger 23 during the heating operation to be pushed out to the suction side of the compressor 21 during the pressure equalization. Thus, it becomes difficult for a large quantity of liquid refrigerant to flow into and collect in the suction side of the compressor 21 from the outdoor heat exchanger 23 during the pressure equalization. In this way, by performing the pressure equalization control when stopping the heating operation, it can be made difficult for the compressor 21 to suck in liquid refrigerant when the heating operation is resumed, even when the air conditioning apparatus 1 employs as the outdoor heat exchanger 23 a heat exchanger that uses multi-hole flat tubes as the heat transfer tubes 231, Furthermore, in the present embodiment, the air conditioning apparatus 1 employs a configuration having the accumulator 25, so even if liquid refrigerant were to be pushed out to the suction side of the compressor 21 from the outdoor heat exchanger 23 during the pressure equalization of the refrigerant circuit 10 when stopping the heating operation, this liquid refrigerant can be accumulated in the accumulator 25. For this reason, in terms of the configuration of the refrigerant circuit 10, it becomes difficult thr the compressor 21 to suck in liquid refrigerant when the heating operation is resumed. However, even in a configuration having the accumulator 25, there are cases where liquid refrigerant has already accumulated in the accumulator 25 during the heating operation. In this case, if the above-described pressure equalization control is not performed and liquid refrigerant is allowed to be pushed out to the suction side of the compressor 21 from the outdoor heat exchanger 23 during the pressure equalization of the refrigerant circuit 10 when stopping the heating operation, the quantity of liquid refrigerant accumulating in the accumulator 25 during the pressure equalization ends up becoming extremely large. Thus, there is the concern that when the heating operation is resumed, the liquid refrigerant accumulating in the accumulator 25 will end up overflowing out to the suction side of the compressor 21 and that the compressor 21 will suck in the liquid refrigerant. In contrast, here, the air conditioning apparatus 1 is configured to perform the above-described pressure equalization control despite the fact that it has a configuration having the accumulator 25, so the liquid refrigerant accumulating in the accumulator 25 can be kept from overflowing out to the suction side of the compressor 21 when the heating operation is resumed. It is preferred that the pressure equalization of the refrigerant circuit 10 be performed quickly during the pressure equalization control, so the opening degree of the expansion valve 24 is set to a pressure equalization opening degree Xeq, which is a larger opening degree than during accumulator refrigerant discharge control and four-way switching noise reduction control described later.

Here, because of the above-described pressure equalization control, liquid refrigerant can be kept from being pushed out to the suction side of the compressor 21 from the outdoor heat exchanger 23 when the air conditioning apparatus 1 stops the heating operation. However, it is not the case that, because of this, liquid refrigerant will no longer collect in the outdoor heat exchanger 23. For this reason, there remains the concern that when the heating operation is resumed, some of the liquid refrigerant that has collected in the outdoor heat exchanger 23 will be pushed out to the suction side of the compressor 21 and that the liquid refrigerant will flow into the suction side of the compressor 21 from the outdoor heat exchanger 23. Therefore, here, at the time of the pressure equalization control, the air conditioning apparatus 1 is configured to perform outdoor heat exchanger refrigerant discharge control that switches the four-way switching valve 22 to the cooling cycle state and thereafter continues the operation of the compressor 21. Specifically, the air conditioning apparatus 1 switches the four-way switching valve 22 to the cooling cycle state, thereafter continues the operation of the compressor 21, and stops the compressor 21 after about 40 to 80 seconds have elapsed (see time t3 in FIG. 6). Because of this, the timing when the air conditioning apparatus 1 stops the compressor 21 is delayed compared to the timing when the air conditioning apparatus 1 switches the four-way switching valve 22 to the cooling cycle state, and a flow of refrigerant that circulates in the same way as during the cooling operation can be generated in the refrigerant circuit 10 before the air conditioning apparatus 1 stops the compressor 21. For this reason, liquid refrigerant that has collected in the heat transfer tubes 231 comprising multi-hole flat tubes of the outdoor heat exchanger during the heating operation can be discharged through the expansion valve 24 to the indoor heat exchanger 41 side before the air conditioning apparatus 1 stops the compressor 21. Thus, during the pressure equalization, it not only becomes difficult for a large quantity of liquid refrigerant to flow into and collect in the suction side of the compressor 21 from the outdoor heat exchanger 23, but the quantity of liquid refrigerant collecting in the outdoor heat exchanger 23 after the heating operation is stopped can also be reduced. In this way, by performing the outdoor heat exchanger refrigerant discharge control, the concern that liquid refrigerant will flow into the suction side of the compressor 21 from the outdoor heat exchanger 23 when the heating operation is resumed can be reduced. During the outdoor heat exchanger refrigerant discharge control, it is preferred that the discharge of the liquid refrigerant that has accumulated in the outdoor heat exchanger 23 be accelerated, so the operating frequency of the compressor 21 is set to an outdoor heat exchanger refrigerant discharge control frequency fex, which is a larger operating frequency than during the accumulator refrigerant discharge control and the four-way switching noise reduction control described later.

Furthermore, the above-described outdoor heat exchanger refrigerant discharge control generates in the refrigerant circuit 10 a flow of refrigerant that circulates in the same way as during the cooling operation, so the indoor heat exchanger 41 functions as an evaporator of the refrigerant. For this reason, in a configuration having the indoor fan 42 like in the present embodiment, although it is temporary, cool air ends up being blown into the room and a cool sensation ends up being imparted to the people in the room, which is undesirable. Therefore, here, at the time of the outdoor heat exchanger refrigerant discharge control, the air conditioning apparatus 1 is configured to perform control that stops the indoor fan 42. Specifically, the air conditioning apparatus 1 performs an operation that switches the four-way switching valve 22 from the heating cycle state to the cooling cycle state and thereafter stops the indoor fan 42. Because of this, at the time of the outdoor heat exchanger refrigerant discharge control, it can be ensured that cool air is not blown into the room and it can be made difficult for a cool sensation to be imparted to the people in the room. However, in a case where it is not necessary to take into consideration a cool sensation being imparted to the people in the room, the indoor fan 42 does not have to be stopped at the time of the outdoor heat exchanger refrigerant discharge control.

Furthermore, the above-described outdoor heat exchanger refrigerant discharge control generates in the refrigerant circuit 10 a flow of refrigerant that circulates in the same way as during the cooling operation, so the outdoor heat exchanger 23 functions as a condenser of the refrigerant. For this reason, in a configuration having the outdoor fan 36, the generation of liquid refrigerant in the outdoor heat exchanger 23 is accelerated despite the fact that liquid refrigerant that has accumulated in the outdoor heat exchanger 23 during the heating operation is discharged to the indoor heat exchanger 41 side by the outdoor heat exchanger refrigerant discharge control, which is undesirable. Therefore, here, the air conditioning apparatus 1 is configured to perform control that stops the outdoor fan 36 at the time of the outdoor heat exchanger refrigerant discharge control. Specifically, the air conditioning apparatus 1 performs an operation that switches the four-way switching valve 22 from the heating cycle state to the cooling cycle state and thereafter stops the outdoor fan 36. Because of this, at the time of the outdoor heat exchanger refrigerant discharge control, liquid refrigerant can be kept from being generated in the outdoor heat exchanger 23 and the discharge of the liquid refrigerant that has accumulated in the outdoor heat exchanger 23 through the expansion valve 24 to the indoor heat exchanger 41 side can be accelerated. However, in a case where liquid refrigerant that has accumulated in the outdoor heat exchanger 23 cannot be sufficiently discharged even if the outdoor fan 36 is not stopped, the outdoor fan 36 does not have to be stopped at the time of the outdoor heat exchanger refrigerant discharge control.

<Step ST1>

As described above, in the present embodiment, the air conditioning apparatus 1 is configured to perform the pressure equalization control of step ST4 despite the fact that it has a configuration having the accumulator 25. For this reason, when the heating operation is resumed, liquid refrigerant accumulating in the accumulator 25 can generally be kept from overflowing out to the suction side of the compressor 21. Yet in a case where, when the air conditioning apparatus 1 stops the heating operation, the quantity of liquid refrigerant accumulating in the accumulator 25 is extremely large, some concern remains that even if the pressure equalization control of step ST4 is performed, the liquid refrigerant accumulating in the accumulator 25 will not be able to be kept from flowing out to the suction side of the compressor 21 when the heating operation is resumed. Therefore, here, the air conditioning apparatus 1 is configured to not only perform the pressure equalization control of step ST4 but also perform accumulator refrigerant discharge control (step ST1) that reduces the opening degree of the expansion valve 24 before the pressure equalization control. Specifically, the air conditioning apparatus 1 operates the compressor 21 in a state in which the opening degree of the expansion valve 24 has been reduced for about 120 to 240 seconds (see time t1 in FIG. 7) after receiving a command to stop the heating operation. Because of this, by reducing, before the pressure equalization control, the opening degree of the expansion valve 24 while maintaining in the refrigerant circuit 10 a flow of the refrigerant that circulates in the same way as during the heating operation, a pump down-like operation that sends the liquid refrigerant to the indoor heat exchanger 41 side of the expansion valve 24 can be performed. For this reason, before the pressure equalization control, refrigerant that has accumulated in the accumulator 25 can be discharged and sent through the compressor 21 to the indoor heat exchanger 41 side, and the flow rate of the refrigerant returning to the outdoor heat exchanger 23 and the accumulator 25 can be reduced. Thus, before the pressure equalization control, a state in which the quantity of liquid refrigerant accumulating in the accumulator 25 is extremely large can be eliminated, and the quantity of liquid refrigerant that accumulates in the outdoor heat exchanger 23 during the pressure equalization and after stopping the heating operation can be reduced. In this way, by performing the accumulator refrigerant discharge control, liquid refrigerant accumulating in the accumulator 25 can be kept from overflowing out to the suction side of the compressor 21. During the accumulator refrigerant discharge control, in order to make it easier for a pump down-like operating state to be obtained, it is preferred that the opening degree of the expansion valve 24 be set to an accumulator refrigerant discharge opening degree Xac, which is smaller than the opening degree before starting the accumulator refrigerant discharge control and the pressure equalization opening degree Xeq. For example, the accumulator refrigerant discharge opening degree Xac is set to an opening degree that is equal to or less than 0.2 times the pressure equalization opening degree Xeq. Furthermore, in order to avoid a sudden drop in the low pressure in the refrigeration cycle, it is preferred that the operating frequency of the compressor 21 be set to an accumulator refrigerant discharge frequency fax, which is smaller than the outdoor heat exchanger refrigerant discharge frequency fex. For example, the accumulator refrigerant discharge frequency fac is set to an operating frequency that is about 0.5 to 0.8 times the outdoor heat exchanger refrigerant discharge frequency fex. However, the accumulator refrigerant discharge control does not have to be performed in a case where the air conditioning apparatus 1 has a configuration not having the accumulator 25 or a case where liquid refrigerant accumulating in the accumulator 25 can be kept from overflowing by just performing the pressure equalization control.

After performing the accumulator refrigerant discharge control of step ST1, the air conditioning apparatus 1 moves to the processing of steps ST2 and ST3.

<Step ST2 and Step ST3>

In the pressure equalization control of step ST4, the four-way switching valve 22 is switched from the heating cycle state to the cooling cycle state in a state in which the pressure in the refrigerant circuit 10 is not equalized. For this reason, the switching becomes performed in a state in which the high-low pressure difference between the four ports 22*a* to 22*d* of the four-way switching valve 22 is large, and the switching noise made during the switching operation of the four-way switching valve 22 tends to become louder. Therefore, here, the air conditioning apparatus 1 is configured to perform, before the pressure equalization control of ST4, four-way switching noise reduction control that reduces the operating frequency of the compressor 21 (step ST3). Specifically, in the present embodiment, the air conditioning apparatus 1 performs the accumulator refrigerant discharge control of step ST1, so the air conditioning apparatus 1 performs an operation that reduces the operating frequency of the compressor 21 for about 60 to 120 seconds (see time t2 in FIG. 7) between the accumulator refrigerant discharge control and the pressure equalization control. Because of this, when the air conditioning apparatus 1 switches the four-way switching valve 22 from the heating cycle state to the cooling cycle state, the high-low pressure difference between the four ports 22*a* to 22*d* of the four-way switching valve 22 can be reduced and the switching noise made by the four-way switching valve 22 can be reduced. In the four-way switching noise reduction control, in order to make it easier to reduce the high-low pressure difference between the four ports 22*a* to 22*d* of the four-way switching valve 22, it is preferred that the operating frequency of the compressor 21 be set to a four-way switching noise reduction frequency fv that is smaller than the operating frequency (in the present embodiment, the accumulator refrigerant discharge frequency fac) before starting the four-way switching noise reduction control. For example, the four-way switching noise reduction frequency fv is set to an operating frequency that is equal to or less than 0.5 times the accumulator refrigerant discharge frequency fac. Furthermore, in order to make it easier to reduce the high-low pressure difference between the four ports 22*a* to 22*d* of the four-way switching valve 22, the opening degree of the expansion valve 24 is set to a four-way switching noise reduction opening degree Xv that is equal to or smaller than the accumulator refrigerant discharge opening degree Xac. However, in a case where, due to the placement of the outdoor unit 2, for example, it is not necessary to reduce the switching noise made by the four-way switching valve 22, the four-way switching noise reduction control does not have to be performed.

Here, even in a case where it is necessary to perform the four-way switching noise reduction control due to the placement of the outdoor unit 2, for example, there are cases where performing the four-way switching noise reduction control is undesirable. That is, as described above, the object of the four-way switching noise reduction control is to reduce the switching noise made during the switching operation of the four-way switching valve 22. For this reason, when the air conditioning apparatus 1 stops the heating operation as a result of the thermo-off or receiving a command from the remote controller (not shown in the drawings), it is preferred that the air conditioning apparatus 1 perform the four-way switching noise reduction control, but in the case of an abnormal stop caused by a device abnormality, for example, it is preferred that device protection be given priority over reducing the switching noise made by the four-way switching valve 22 and that the air conditioning apparatus 1 be stopped quickly. Therefore, here, the air conditioning apparatus 1 is configured to not perform the four-way switching noise reduction control in a case where the stopping of the heating operation is an abnormal stop (step ST2). That is, when stopping the heating operation as a result of the thermo-off or receiving a command from the remote controller (not shown in the drawings), the air conditioning apparatus 1 is configured to perform the pressure equalization control after performing the four-way switching noise reduction control, and in the case of an abnormal stop, the air conditioning apparatus 1 is configured to perform the pressure equalization control without performing the four-way switching noise reduction control. Because of this, the pressure equalization control can be performed white giving appropriate consideration to both the switching noise made during the switching operation of the four-way switching valve 22 and device protection.

(4) Example Modification 1

In the above-described embodiment, the air conditioning apparatus 1 employs as the outdoor heat exchanger 23 an insertion fin stacked heat exchanger configured by the plural heat transfer tubes 231 comprising multi-hole flat tubes and the numerous insertion fins 232 (see FIG. 2 to FIG. 4), but the air conditioning apparatus 1 is not limited to this.

Figure 8:
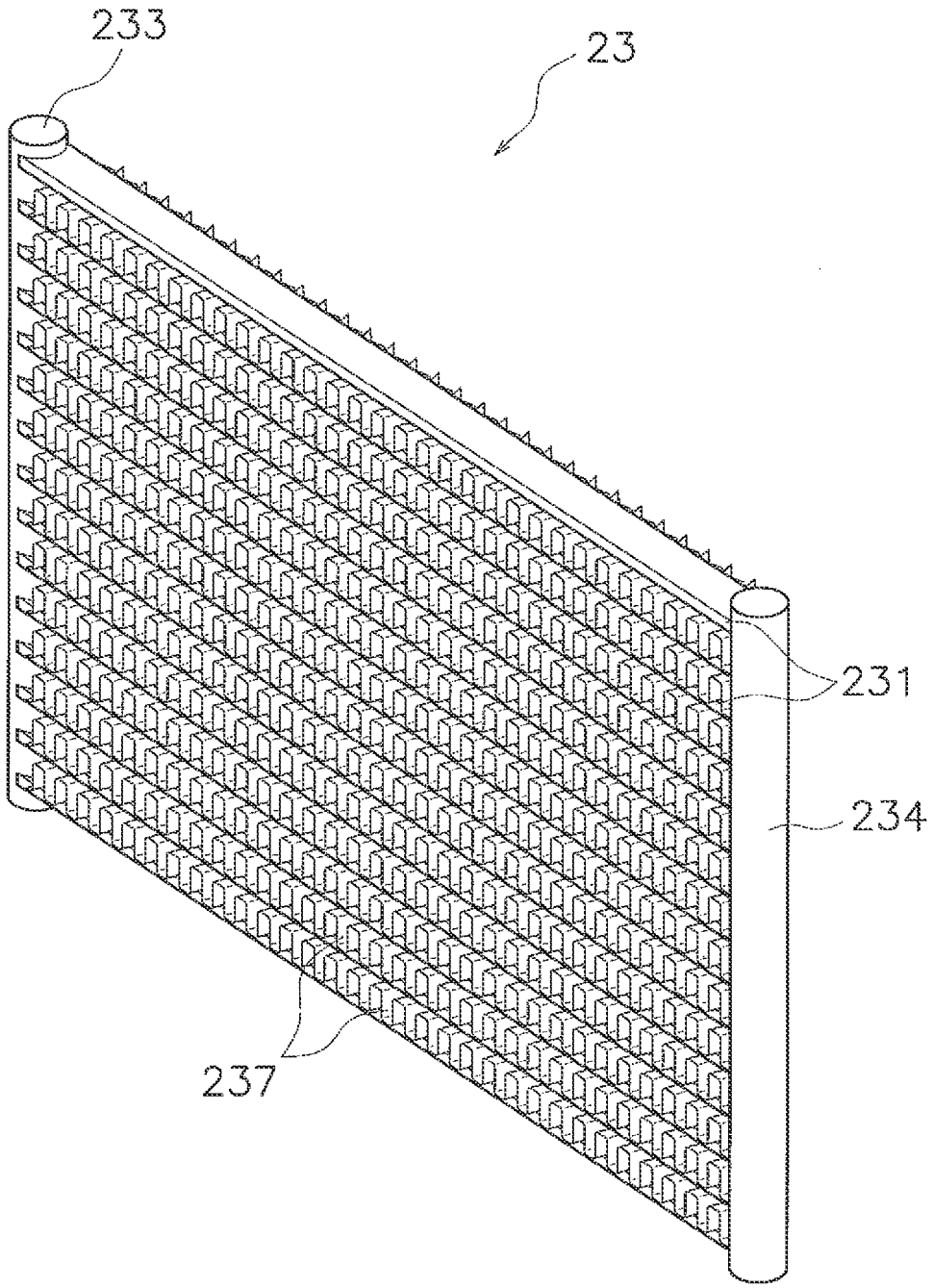
FIG. 8 is an external perspective view of the outdoor heat exchanger in example modification 1.

For example, as shown in FIG. 8, the air conditioning apparatus 1 may also employ as the outdoor heat exchanger 23 a corrugated fin stacked heat exchanger configured by the plural, heat transfer tubes 231 comprising multi-hole flat tubes and numerous corrugated fins 237. Here, the corrugated fins 237 are fins made of aluminum or aluminum alloy bent in a corrugated shape. The corrugated fins 237 are disposed in air flow spaces sandwiched by the vertically adjacent heat transfer tubes 231, and the grooves and ridges of the corrugated fins 237 are in contact with the planar portions of the heat transfer tubes 231.

In this case also, by performing the same heating stop control as in the above-described embodiment, it can be ensured that liquid refrigerant that has collected in the heat transfer tubes 231 comprising multi-hole flat tubes is not pushed out to the suction side of the compressor 21 during the pressure equalization of the refrigerant circuit 10. Because of this, like in the above-described embodiment, it can be made difficult for the compressor 21 to suck in liquid refrigerant when the heating operation is resumed.

(5) Example Modification 2

In the above-described embodiment and example modification 1, the air conditioning apparatus 1 is configured to perform the accumulator refrigerant discharge control of step ST1 for just the time t1, but the air conditioning apparatus 1 is not limited to this. For example, in a case where the degree of superheat SH of the refrigerant in the suction side of the compressor 21 has reached a predetermined accumulator refrigerant discharge completion degree of superheat SHace, the air conditioning apparatus 1 may also be configured to end the accumulator refrigerant discharge control and move to the processing of steps ST2 to ST4 even before the time t1 elapses. Because of this, a contribution can be made to shorten the amount of time of the accumulator refrigerant discharge control. Here, the degree of superheat SH of the refrigerant in the suction side of the compressor 21 can be obtained, for example, by subtracting the temperature Tor of the refrigerant in the outdoor heat exchanger 23 from the temperature Ts of the low-pressure refrigerant sucked into the compressor 21.

Furthermore, in the above-described embodiment and example modification 1, the air conditioning apparatus 1 fixes the opening degree of the expansion valve 24 during the accumulator refrigerant discharge control of step ST1 at the accumulator refrigerant discharge opening degree Xac, but the air conditioning apparatus 1 is not limited to this. For example, the air conditioning apparatus 1 may also be configured to vary the accumulator refrigerant discharge opening degree Xac by controlling the opening degree of the expansion valve 24 in such a way that the degree of superheat SH of the refrigerant in the suction side of the compressor 21 becomes constant at a predetermined accumulator refrigerant discharge control degree of superheat SHacc. Because of this, a contribution can be made to shorten the amount of time of the accumulator refrigerant discharge control.

(6) Example Modification 3

In the above-described embodiment and example modifications 1 and 2, the air conditioning apparatus 1 is configured to perform the four-way switching noise reduction control of step ST3 for just the time t2, but the air conditioning apparatus 1 is not limited to this. For example, in a case where the degree of superheat SH of the refrigerant in the suction side of the compressor 21 has reached a predetermined four-way switching noise reduction degree of superheat SHv, the air conditioning apparatus 1 may also be configured to end the four-way switching noise reduction control and move to the processing of step ST4 even before the time t2 elapses. Furthermore, in a case where the temperature Td of the high-pressure refrigerant discharged from the compressor 21 has reached a predetermined four-way switching noise reduction discharge temperature Tdv, the air conditioning apparatus 1 may also be configured to end the four-way switching noise reduction control and move to the processing of step ST4 even before the time t2 elapses.

Furthermore, in the above-described embodiment and example modifications 1 and 2, in the four-way switching noise reduction control of step ST3, the air conditioning apparatus 1 fixes the operating frequency of the compressor 21 at the four-way switching noise reduction frequency fv, but the air conditioning apparatus 1 is not limited to this. For example, the air conditioning apparatus 1 may also be configured to reduce the four-way switching noise reduction frequency fv in stages during the time t2. Furthermore, in the above-described embodiment and example modifications 1 and 2, the air conditioning apparatus 1 fixes the opening degree of the expansion valve 24 at the four-way switching noise reduction opening degree Xv, but the air conditioning apparatus 1 may also be configured to increase the opening degree of the expansion valve 24 in stages during the time t2. Moreover, in a case where the outdoor fan 36 is a variable air volume fan, in the four-way switching noise reduction control of step ST3, the air conditioning apparatus 1 may also be configured to make the air volume of the outdoor fan 36 smaller than the air volume during the accumulator refrigerant discharge control of step ST1. Because of this, the four-way switching noise reduction control can be stably performed.

(7) Example Modification 4

In the above-described embodiment and example modifications 1 to 3, when a command to stop the heating operation is given as a result of the thermo-off or by the remote controller (not shown in the drawings) during the heating operation, the air conditioning apparatus 1 is configured to perform the pressure equalization control of step ST4; that is, when stopping the heating operation, the air conditioning apparatus 1 is configured to switch the four-way switching valve 22 from the heating cycle state to the cooling cycle state, stop the compressor 21, and equalize the pressure in the refrigerant circuit 10.

However, in a case where, even during the heating operation, a command to stop the heating operation has been given by the remote controller (not shown in the drawings) during the defrost operation, the four-way switching valve 22 becomes switched to the cooling cycle state before the air conditioning apparatus 1 performs the pressure equalization control of step ST4.

Therefore, in a case where, even during the heating operation, a command to stop the heating operation has been given by the remote controller (not shown in the drawings), the air conditioning apparatus 1 may also be configured to stop the heating operation without performing the pressure equalization control of step ST4. By continuing the defrost operation itself until a predetermined defrost operation completion condition (e.g., a predetermined amount of time elapses, or the temperature of the refrigerant in the outdoor heat exchanger 23 rises to a predetermined temperature) is met, the result is substantially the same as if the outdoor heat exchanger refrigerant discharge control during the pressure equalization control had also been performed. In this way, by stopping the heating operation without performing the pressure equalization control of step ST4 in a case where a command to stop the heating operation has been given by the remote controller not shown in the drawings) during the defrost operation, the processing for stopping the heating operation can be completed in a short amount of time.

INDUSTRIAL APPLICABILITY

The present invention is widely applicable to air conditioning apparatus that use a four-way switching valve to switch between and perform a cooling operation and a heating operation.

What is claimed is:

1. An air conditioning apparatus comprising:

a refrigerant circuit including a compressor, a four-way switching valve, an outdoor heat exchanger, an expansion valve, and an indoor heat exchanger interconnected with each other, the refrigerant circuit being configured to switch the four-way switching valve to a cooling cycle state to thereby perform a cooling operation that circulates refrigerant through the compressor, the outdoor heat exchanger, the expansion valve, and the indoor heat exchanger in order, and the four-way switching valve to a heating cycle state to thereby perform a heating operation that circulates the refrigerant through the compressor, the indoor, heat exchanger, the expansion valve, and the outdoor heat exchanger in order, the outdoor heat exchanger using multi-hole flat tubes as heat transfer tubes, when stopping the heating operation, the air conditioning apparatus performs pressure equalization control that switches the four-way switching valve from the heating cycle state to the cooling cycle state, and thereafter stops the compressor, and equalizes pressure in the refrigerant circuit, and a first opening degree of the expansion valve after the four-way switching valve is switched from the heating cycle state to the cooling cycle state being greater than a second opening degree of the expansion valve when the four-way switching valve is switched from the heating cycle state to the cooling cycle state.

2. The air conditioning apparatus according to claim 1, wherein when the pressure equalization control is performed, the air conditioning apparatus performs outdoor heat exchanger refrigerant discharge control that switches the four-way switching valve to the cooling cycle state and thereafter continues operation of the compressor in the cooling cycle state prior to stopping the compressor.

3. An air conditioning apparatus comprising:

a refrigerant circuit including a compressor, a four-way switching valve, an outdoor heat exchanger, an expansion valve, and an indoor heat exchanger interconnected with each other, the refrigerant circuit being configured to switch the four-way switching valve to a cooling cycle state to thereby perform a cooling operation that circulates refrigerant through the compressor, the outdoor heat exchanger, the expansion valve, and the indoor heat exchanger in order, and the four-way switching valve to a heating cycle state to thereby perform a heating operation that circulates the refrigerant through the compressor, the indoor heat exchanger, the expansion valve, and the outdoor heat exchanger in order, the outdoor heat exchanger using multi-hole flat tubes as heat transfer tubes, an indoor fan arranged and configured to supply room air to the indoor heat exchanger, the room air serving as a heating source or a cooling source of the refrigerant flowing through the indoor heat exchanger, when stopping the heating operation, the air conditioning apparatus performs pressure equalization control that switches the four-way switching valve from the heating cycle state to the cooling cycle state, and thereafter stops the compressor, and equalizes pressure in the refrigerant circuit, when performing the pressure equalization control, the air conditioning apparatus performs outdoor heat exchanger refrigerant discharge control that switches the four-way switching valve to the cooling cycle state and thereafter continues operation of the compressor in the cooling cycle state prior to stopping the compressor, and when the outdoor heat exchanger refrigerant discharge control is performed, the air conditioning apparatus switches the four-way switching valve to the cooling cycle state and thereafter stopping the indoor fan.

4. An air conditioning apparatus comprising:

a refrigerant circuit including a compressor, a four-way switching valve, an outdoor heat exchanger, an expansion valve, and an indoor heat exchanger interconnected with each other, the refrigerant circuit being configured to switch the four-way switching valve to a cooling cycle state to thereby perform a cooling operation that circulates refrigerant through the compressor, the outdoor heat exchanger, the expansion valve, and the indoor heat exchanger in order, and the four-way switching valve to a heating cycle state to thereby performs a heating operation that circulates the refrigerant through the compressor, the indoor heat exchanger, the expansion valve, and the outdoor heat exchanger in order, the outdoor heat exchanger using multi-hole flat tubes as heat transfer tubes, an outdoor fan arranged and configured to supply outdoor air to the outdoor heat exchanger, the outdoor air serving as a cooling source or a heating source of the refrigerant flowing through the outdoor heat exchanger, when stopping the heating operation, the air conditioning anaratus performs pressure equalization control that switches the four-way switching valve from the heating cycle state to the cooling cycle state, and thereafter stops the compressor, and equalizes pressure in the refrigerant circuit, when performing the pressure equalization control, the air conditioning apparatus performs outdoor heat exchanger refrigerant discharge control that switches the four-way switching valve to the cooling cycle state and thereafter continues operation of the compressor in the cooling cycle state prior to stopping the compressor, and when the outdoor heat exchanger refrigerant discharge control is performed, the air conditioning apparatus switches the four-way switching valve to the cooling cycle state and thereafter stopping the outdoor fan.

5. The air conditioning apparatus according to claim 1, wherein the refrigerant circuit further has an accumulator arranged and configured to temporarily accumulate refrigerant sucked into the compressor, and before the pressure equalization control, the air conditioning apparatus performs accumulator refrigerant discharge control that reduces an opening degree of the expansion valve.

6. The air conditioning apparatus according to claim 1, wherein before the pressure equalization control, the air conditioning apparatus performs four-way switching noise reduction control that reduces an operating frequency of the compressor.

7. The air conditioning apparatus according to claim 6, wherein in a case where the stopping of the heating operation is an abnormal stop, the air conditioning apparatus does not perform the four-way switching noise reduction control.

8. The air conditioning apparatus according to claim 3, further comprising an outdoor fan arranged and configured to supply outdoor air to the outdoor heat exchanger, the outdoor air serving as a cooling source or a heating source of the refrigerant flowing through the outdoor heat exchanger, when the outdoor heat exchanger refrigerant discharge control is performed, the air conditioning apparatus switching the four-way switching valve to the cooling cycle state and thereafter stopping the outdoor fan.

9. The air conditioning apparatus according to claim 3, wherein the refrigerant circuit further has an accumulator arranged and configured to temporarily accumulate refrigerant sucked into the compressor, and before the pressure equalization control, the air conditioning apparatus performs accumulator refrigerant discharge control that reduces an opening degree of the expansion valve.

10. The air conditioning apparatus according to claim 3, wherein before the pressure equalization control, the air conditioning apparatus performs four-way switching noise reduction control that reduces an operating frequency of the compressor.

11. The air conditioning apparatus according to claim 10, wherein in a case where the stopping of the heating operation is an abnormal stop, the air conditioning apparatus does not perform the four-way switching noise reduction control.

12. The air conditioning apparatus according to claim 4, wherein the refrigerant circuit further has an accumulator arranged and configured to temporarily accumulate refrigerant sucked into the compressor, and before the pressure equalization control, the air conditioning apparatus performs accumulator refrigerant discharge control that reduces an opening degree of the expansion valve.

13. The air conditioning apparatus according to claim 4, wherein before the pressure equalization control, the air conditioning apparatus performs four-way switching noise reduction control that reduces an operating frequency of the compressor.

14. The air conditioning apparatus according to claim 13, wherein in a case where the stopping of the heating operation is an abnormal stop, the air conditioning apparatus does not perform the four-way switching noise reduction control.

15. The air conditioning apparatus according to claim 2, wherein the refrigerant circuit further has an accumulator arranged and configured to temporarily accumulate refrigerant sucked into the compressor, and before the pressure equalization control, the air conditioning apparatus performs accumulator refrigerant discharge control that reduces an opening degree of the expansion valve.

16. The air conditioning apparatus according to claim 2, wherein before the pressure equalization control, the air conditioning apparatus performs four-way switching noise reduction control that reduces an operating frequency of the compressor.

17. The air conditioning apparatus according to claim 16, wherein in a case where the stopping of the heating operation is an abnormal stop, the air conditioning apparatus does not perform the four-way switching noise reduction control.

18. The air conditioning apparatus according to claim 5, wherein before the pressure equalization control, the air conditioning apparatus performs four-way switching noise reduction control that reduces an operating frequency of the compressor.

19. The air conditioning apparatus according to claim 18, wherein in a case where the stopping of the heating operation is an abnormal stop, the air conditioning apparatus does not perform the four-way switching noise reduction control.

* * * * *